US007669952B2

(12) United States Patent
Silverbrook

(10) Patent No.: US 7,669,952 B2
(45) Date of Patent: Mar. 2, 2010

(54) PRINTHEAD INTEGRATED CIRCUIT ASSEMBLY WITH COMPENSATION CONTROLLER

(75) Inventor: Kia Silverbrook, Balmain (AU)

(73) Assignee: Silverbrook Research Pty Ltd, Balmain, New South Wales (AU)

( * ) Notice: Subject to any disclaimer, the term of this patent is extended or adjusted under 35 U.S.C. 154(b) by 153 days.

(21) Appl. No.: 11/923,651

(22) Filed: Oct. 25, 2007

(65) Prior Publication Data

US 2008/0088658 A1 Apr. 17, 2008

Related U.S. Application Data

(63) Continuation of application No. 11/072,517, filed on Mar. 7, 2005, now Pat. No. 7,290,863, which is a continuation of application No. 10/487,827, filed as application No. PCT/AU02/01120 on Aug. 21, 2002, now Pat. No. 6,955,414, which is a continuation of application No. 09/944,400, filed on Sep. 4, 2001, now Pat. No. 6,412,908, which is a continuation-in-part of application No. 09/575,147, filed on May 23, 2000, now Pat. No. 6,390,591.

(51) Int. Cl.
*B41J 29/38* (2006.01)

(52) U.S. Cl. ..... 347/14; 347/54

(58) Field of Classification Search ..... 347/5, 347/9, 12, 14, 17, 19, 56–59, 54
See application file for complete search history.

(56) References Cited

U.S. PATENT DOCUMENTS 4,417,259 A 11/1983 Maeda
4,558,333 A 12/1985 Sugitani et al.
4,736,212 A 4/1988 Oda et al.
4,942,409 A 7/1990 Paton et al.
5,665,249 A 9/1997 Burke et al.
5,808,639 A * 9/1998 Silverbrook ..... 347/57
5,877,788 A 3/1999 Haan et al.
5,929,877 A 7/1999 Hetzer et al.
6,203,140 B1 3/2001 Oyen
6,412,908 B2 7/2002 Silverbrook
2001/0012035 A1 8/2001 Silverbrook
2002/0015072 A1 2/2002 Silverbrook
2002/0018096 A1 2/2002 Silverbrook
2002/0021322 A1 2/2002 Silverbrook

FOREIGN PATENT DOCUMENTS

JP 10-166588 6/1998
JP 2001-199061 7/2001
JP 2001-199066 7/2001
WO WO 96/35584 11/1996
WO WO 98/55317 12/1998

* cited by examiner

*Primary Examiner*—Juanita D Stephens

(57) ABSTRACT

This invention relates to a printhead integrated circuit assembly having a substrate, drive circuitry and a controller. The substrate includes a plurality of micro-electromechanical nozzle arrangements formed thereon. The drive circuitry is positioned on the substrate for operatively actuating the respective nozzle arrangements to eject a drop of printing fluid therefrom. The controller is configured to monitor the power required to eject a drop from each nozzle, and to deactivate such nozzle and compensate with another nozzle if a required power level is exceeded.

6 Claims, 31 Drawing Sheets

PRINTHEAD INTEGRATED CIRCUIT ASSEMBLY WITH COMPENSATION CONTROLLER

CROSS REFERENCE TO RELATED APPLICATIONS

The present application is a Continuation of U.S. application Ser. No. 11/072,517 filed Mar. 7, 2005, now issued U.S. Pat. No. 7,290,863, which is a Continuation of U.S. application Ser. No. 10/487,827 filed Feb. 27, 2004, now issued U.S. Pat. No. 6,955,414, which is a 371 of PCT/AU02/01120 filed Aug. 21, 2002, which is a Continuation of Ser. No. 09/944,400, filed Sep. 4, 2001, now issued U.S. Pat. 6,412,908, which is a Continuation-in-part of Ser. No. 09/575,147 filed May 23, 2000, now issued U.S. Pat. No. 6,390,591, all of which are herein incorporated by reference.

FIELD OF INVENTION

The present invention relates to digital printers and in particular ink jet printers.

BACKGROUND TO THE INVENTION

Ink jet printers are a well known and widely used form of printing. Ink is fed to an array of digitally controlled nozzles on a printhead. As the print head passes over the media, ink is ejected to produce an image on the media.

Printer performance depends on factors such as operating cost, print quality, operating speed and ease of use. The mass, frequency and velocity of individual ink drops ejected from the nozzles will affect these performance parameters.

Recently, the array of nozzles has been formed using micro electro mechanical systems (MEMS) technology, which have mechanical structures with sub-micron thicknesses. This allows the production of printheads that can rapidly eject ink droplets sized in the picoliter ($\times 10^{-12}$ liter) range.

While the microscopic structures of these printheads can provide high speeds and good print quality at relatively low costs, their size makes the nozzles extremely fragile and vulnerable to damage from the slightest contact with fingers, dust or the media substrate. This can make the printheads impractical for many applications where a certain level of robustness is necessary. Furthermore, a damaged nozzle may fail to eject the ink being fed to it. As ink builds up and beads on the exterior of the nozzle, the ejection of ink from surrounding nozzles may be affected and/or the damaged nozzle will simply leak ink onto the substrate. Both situations are detrimental to print quality.

In other situations, a damaged nozzle may simply eject the ink droplets along a misdirected path. Obviously, this also detracts from print quality.

SUMMARY OF THE INVENTION

Accordingly, the present invention provides a printhead for an ink jet printer, the printhead including:

an array of nozzle assemblies for ejecting ink onto media to be printed; and a nozzle guard covering the nozzle array, the nozzle guard having an array of apertures individually corresponding to each of the nozzle assemblies; wherein each of the apertures in the guard are sized and configured to prevent misdirected ink ejected from the nozzle assembly from reaching the media.

In this specification the term "nozzle assembly" is to be understood as an assembly of elements defining, inter alia, an opening. It is not to be interpreted to be a reference to the opening itself.

Preferably, the apertures in the guard are passages with a lengthwise dimension that significantly exceeds the bore size in order to provide a collimator for each of the nozzles.

It will be appreciated that for the purposes of this invention, the cross section of the apertures may be any convenient shape and a reference to the bore size of the aperture is not an implied limitation to a circular cross section.

In a further preferred form, the printhead is adapted to detect an operational fault in any of the nozzle assemblies and stop supply of ink to them. In this form, the printhead may further include a fault tolerance facility that adjusts the operation of other nozzle assemblies within the array to compensate for any damaged nozzle assemblies.

In these embodiments, it is desirable to provide a containment formation for isolating leaked or misdirected ink from at least one of the nozzle assemblies, from the remainder of the nozzle assemblies. In a particularly preferred form, each nozzle assembly in the array has a respective containment formation to isolate any leaked or misdirected ink from each individual nozzle assembly from the remainder of the nozzle assemblies.

In one form, each of the nozzle assemblies use a thermal bend actuator to eject droplets and a control unit adapted to sense the energy required to bend the actuator and compare it to the energy used by a correctly operating nozzle assembly in order to detect an operational fault. In a preferred embodiment, the nozzle has contacts positioned so that a circuit is closed when the bend actuator is at the limit of its travel during actuation so that the control unit can measure the power consumed and time taken in moving the actuator until the circuit closes to calculate the energy required. If the control senses an operational fault in the nozzle, it triggers the fault tolerance facility and stops any further supply of ink to the nozzle assembly.

The containment formation necessarily uses up a proportion of the surface area of the printhead, and this adversely affects the nozzle packing density. The extra printhead chip area required can add 20% to the costs of manufacturing the chip. However, in situations where the nozzle manufacture is unreliable, this will effectively lower the defect rate.

In a particularly preferred form, the nozzle guard is adapted to inhibit damaging contact with the nozzles. Furthermore it is advantageous if the nozzle guard is formed from silicon.

The nozzle guard may further include fluid inlet openings for directing fluid through the passages, to inhibit the build up of foreign particles on the nozzle array.

The nozzle guard may include a support means for supporting the nozzle shield on the printhead. The support means may be integrally formed and comprise a pair of spaced support elements one being arranged at each end of the guard.

In this embodiment, the fluid inlet openings may be arranged in one of the support elements.

It will be appreciated that, when air is directed through the openings, over the nozzle array and out through the passages, the build up of foreign particles on the nozzle array is inhibited.

The fluid inlet openings may be arranged in the support element remote from a bond pad of the nozzle array.

The present invention maintains print quality by retaining misdirected ink ejected from damaged nozzle assemblies. The elongate passages through the guard act as collimators that can collect ink on their side walls. Furthermore, the guard protects the delicate nozzle structures from being touched or bumped against most other surfaces. By forming the shield from silicon, its coefficient of thermal expansion substantially matches that of the nozzle array. This will help to prevent the array of passages in the guard from falling out of register with the nozzle array. Using silicon also allows the shield to be accurately micro-machined using MEMS techniques. Furthermore, silicon is very strong and substantially non-deformable.

BRIEF DESCRIPTION OF THE DRAWINGS

Preferred embodiments of the invention are now described, by way of example only, with reference to the accompanying drawings in which.

DETAILED DESCRIPTION OF THE DRAWINGS

Figure 1:
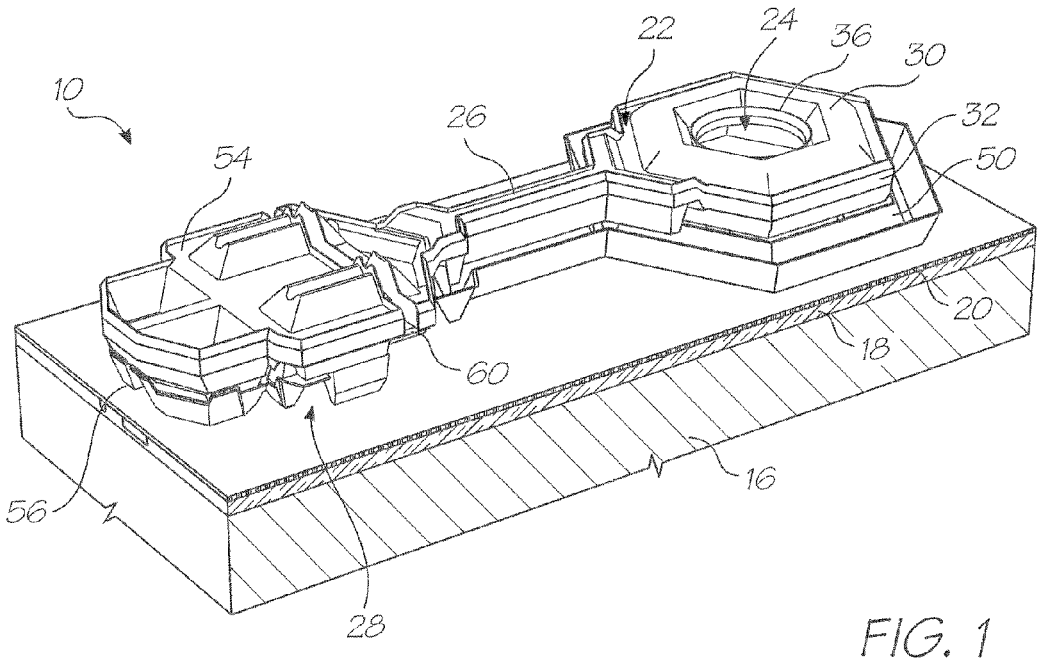
FIG. 1 shows a three dimensional, schematic view of a nozzle assembly for an ink jet printhead.

Referring initially to FIG. 1 of the drawings, a nozzle assembly, in accordance with the invention is designated generally by the reference numeral 10. An ink jet printhead has a plurality of nozzle assemblies 10 arranged in an array 14 (FIGS. 5 and 6) on a silicon substrate 16. The array 14 will be described in greater detail below.

The assembly 10 includes a silicon substrate 16 on which a dielectric layer 18 is deposited. A CMOS passivation layer 20 is deposited on the dielectric layer 18.

Each nozzle assembly 10 includes a nozzle 22 defining a nozzle opening 24, a connecting member in the form of a lever arm 26 and an actuator 28. The lever arm 26 connects the actuator 28 to the nozzle 22.

Figure 2:
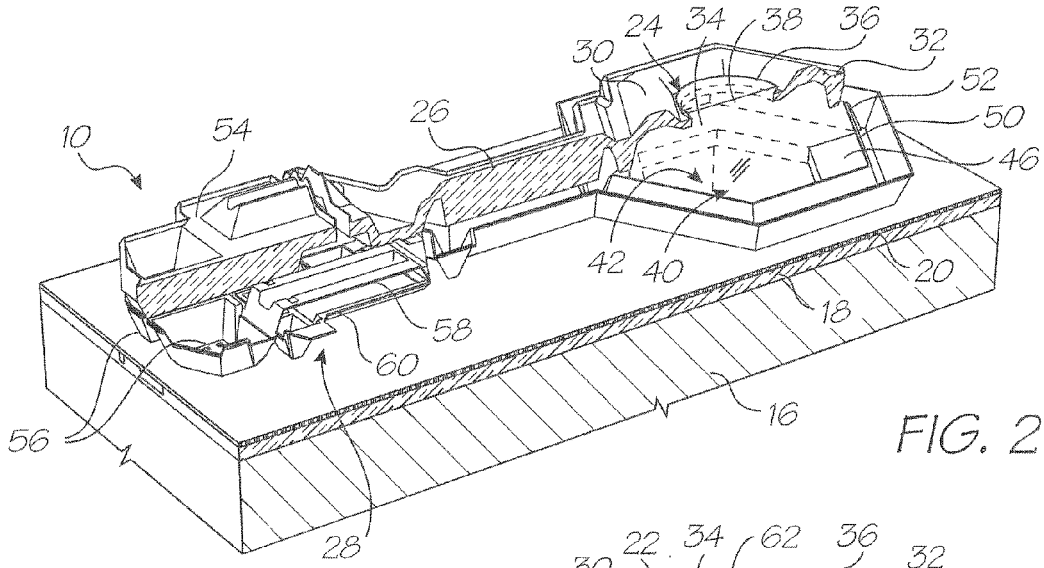
FIGS. 2 to 4 show a three dimensional, schematic illustration of an operation of the nozzle assembly of FIG. 1.
Figure 3:
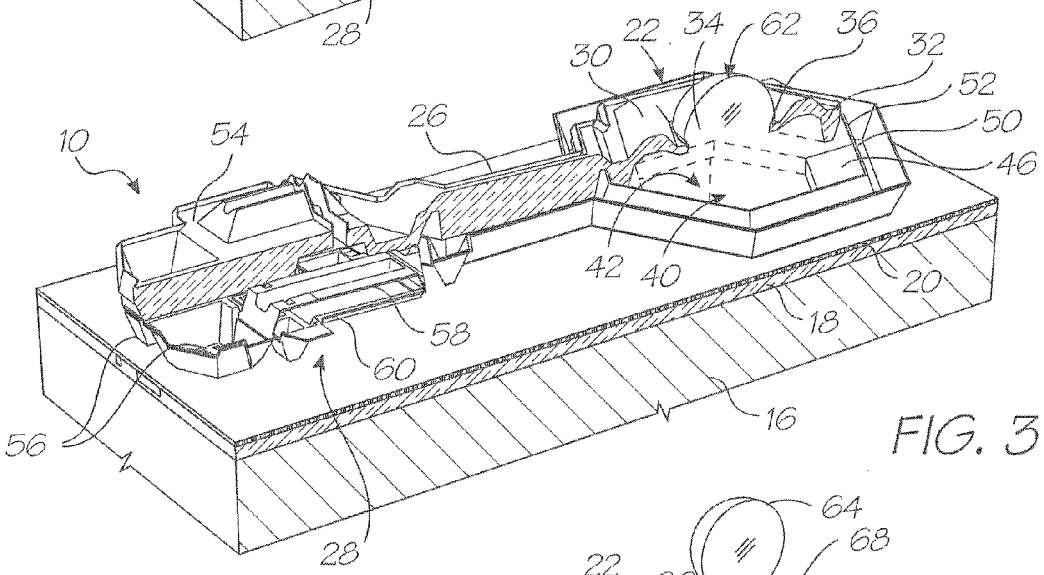
Figure 4:
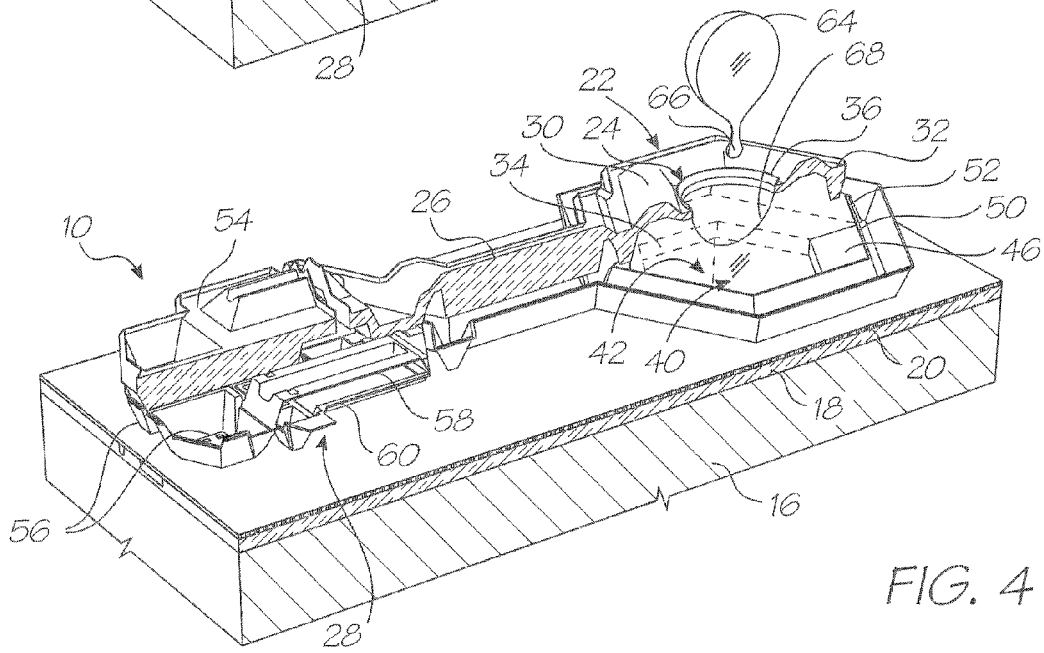

As shown in greater detail in FIGS. 2 to 4, the nozzle 22 comprises a crown portion 30 with a skirt portion 32 depending from the crown portion 30. The skirt portion 32 forms part of a peripheral wall of a nozzle chamber 34. The nozzle opening 24 is in fluid communication with the nozzle 34. It is to be noted that the nozzle opening 24 is surrounded by a raised rim 36 which "pins" a meniscus 38 (FIG. 2) of a body of ink 40 in the nozzle chamber 34.

An ink inlet aperture 42 (shown most clearly in FIG. 6 of the drawings) is defined in a floor 46 of the nozzle chamber 34. The aperture 42 is in fluid communication with an ink inlet channel 48 defined through the substrate 16.

A wall portion 50 bounds the aperture 42 and extends upwardly from the floor portion 46. The skirt portion 32, as indicated above, of the nozzle 22 defines a first part of a peripheral wall of the nozzle chamber 34 and the wall portion 50 defines a second part of the peripheral wall of the nozzle chamber 34.

The wall 50 has an inwardly directed lip 52 at its free end that serves as a fluidic seal to inhibit the escape of ink when the nozzle 22 is displaced, as will be described in greater detail below. It will be appreciated that, due to the viscosity of the ink 40 and the small dimensions of the spacing between the lip 52 and the skirt portion 32, the inwardly directed lip 52 and surface tension function as an effective seal for inhibiting the escape of ink from the nozzle chamber 34.

The actuator 28 is a thermal bend actuator and is connected to an anchor 54 extending upwardly from the substrate 16 or, more particularly from the CMOS passivation layer 20. The anchor 54 is mounted on conductive pads 56 which form an electrical connection with the actuator 28.

The actuator 28 comprises a first, active beam 58 arranged above a second, passive beam 60. In a preferred embodiment, both beams 58 and 60 are of, or include, a conductive ceramic material such as titanium nitride (TiN).

Both beams 58 and 60 have their first ends anchored to the anchor 54 and their opposed ends connected to the arm 26. When a current is caused to flow through the active beam 58 thermal expansion of the beam 58 results. As the passive beam 60, through which there is no current flow, does not expand at the same rate, a bending moment is created causing the arm 26 and, hence, the nozzle 22 to be displaced downwardly towards the substrate 16 as shown in FIG. 3. This causes an ejection of ink through the nozzle opening 24 as shown at 62. When the source of heat is removed from the active beam 58, i.e. by stopping current flow, the nozzle 22 returns to its quiescent position as shown in FIG. 4. When the nozzle 22 returns to its quiescent position, an ink droplet 64 is formed as a result of the breaking of an ink droplet neck as illustrated at 66 in FIG. 4. The ink droplet 64 then travels on to the print media such as a sheet of paper. As a result of the formation of the ink droplet 64, a "negative" meniscus is formed as shown at 68 in FIG. 4 of the drawings. This "negative" meniscus 68 results in an inflow of ink 40 into the nozzle chamber 34 such that a new meniscus 38 (FIG. 2) is formed in readiness for the next ink drop ejection from the nozzle assembly 10.

Figure 5:
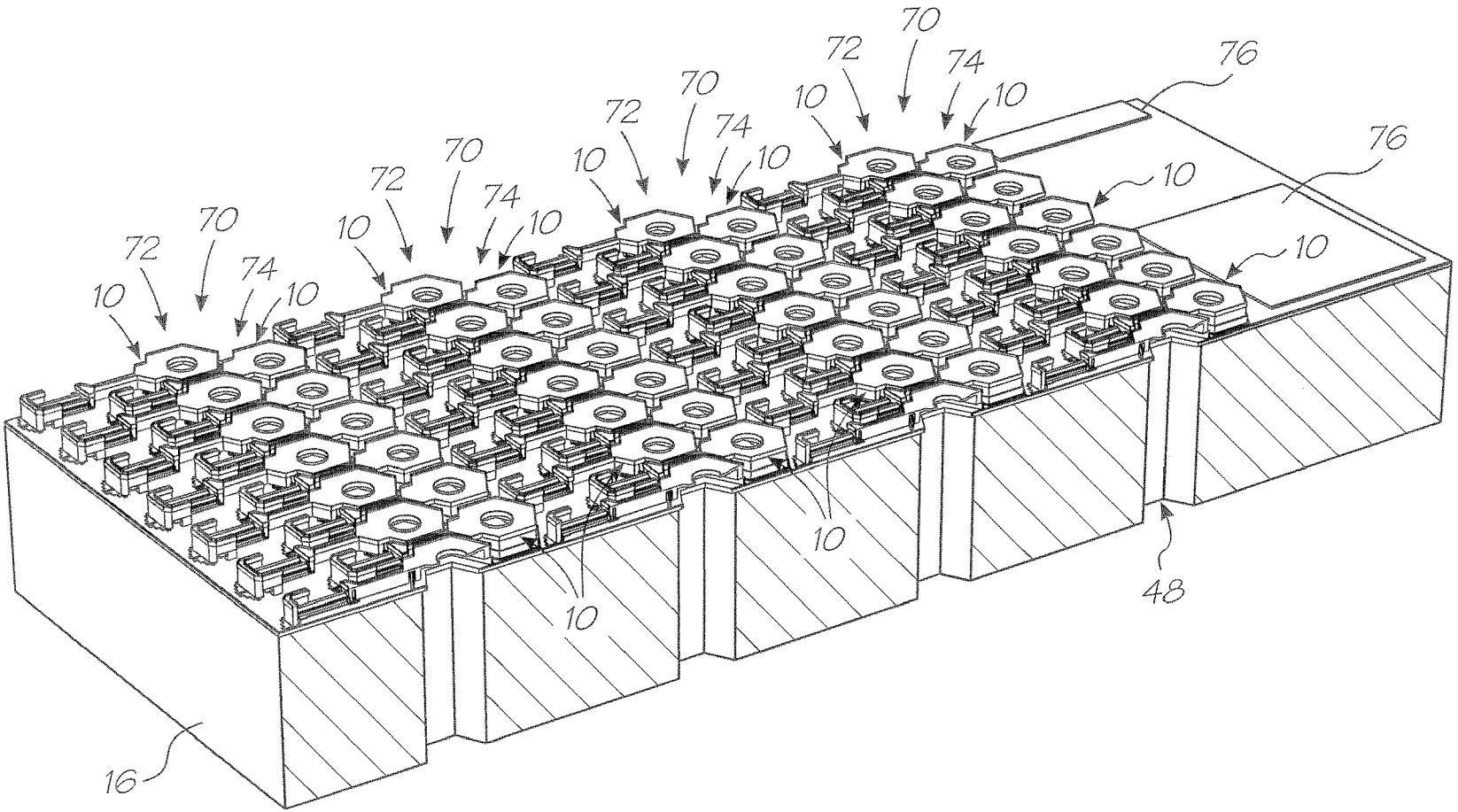
FIG. 5 shows a three dimensional view of a nozzle array constituting an inkjet printhead with a nozzle guard or containment walls.
Figure 6:
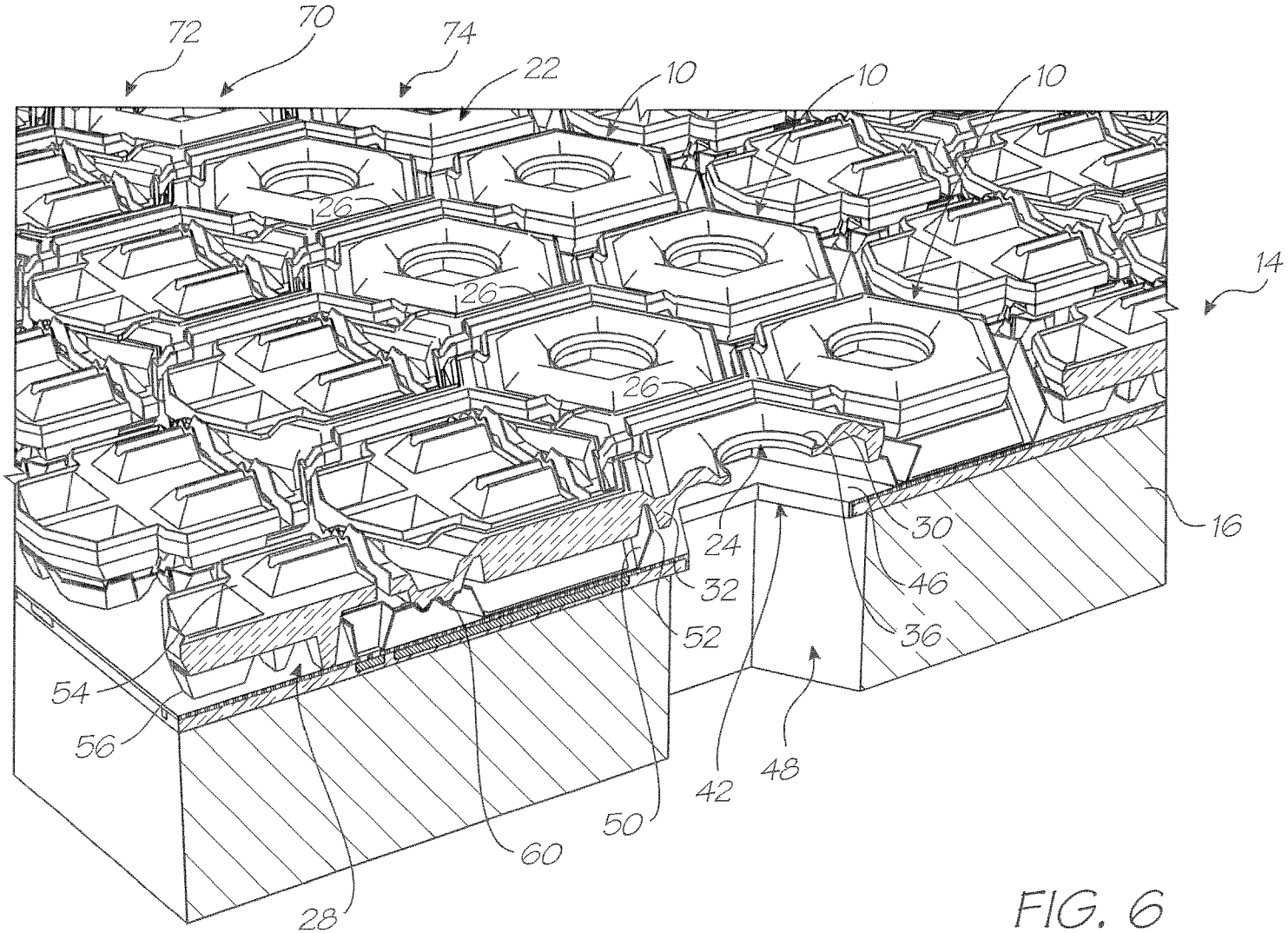
FIG. 6 shows, on an enlarged scale, part of the array of FIG. 5.

Referring now to FIGS. 5 and 6 of the drawings, the nozzle array 14 is described in greater detail. The array 14 is for a four color printhead. Accordingly, the array 14 includes four groups 70 of nozzle assemblies, one for each color. Each group 70 has its nozzle assemblies 10 arranged in two rows 72 and 74. One of the groups 70 is shown in greater detail in FIG. 6.

To facilitate close packing of the nozzle assemblies 10 in the rows 72 and 74, the nozzle assemblies 10 in the row 74 are offset or staggered with respect to the nozzle assemblies 10 in the row 72. Also, the nozzle assemblies 10 in the row 72 are spaced apart sufficiently far from each other to enable the lever arms 26 of the nozzle assemblies 10 in the row 74 to pass between adjacent nozzles 22 of the assemblies 10 in the row 72. It is to be noted that each nozzle assembly 10 is substantially dumbbell shaped so that the nozzles 22 in the row 72 nest between the nozzles 22 and the actuators 28 of adjacent nozzle assemblies 10 in the row 74.

Further, to facilitate close packing of the nozzles 22 in the rows 72 and 74, each nozzle 22 is substantially hexagonally shaped.

It will be appreciated by those skilled in the art that, when the nozzles 22 are displaced towards the substate 16, in use, due to the nozzle opening 24 being at a slight angle with respect to the nozzle chamber 34 is ejected slightly off the perpendicular. It is an advantage of the arrangement shown in FIGS. 5 and 6 of the drawings that the actuators 28 of the nozzle assemblies 10 in the rows 72 and 74 extend in the same direction to one side of the rows 72 and 74. Hence, the ink ejected from the nozzles 22 in the row 72 and the ink ejected from the nozzles 22 in the row 74 are offset with respect to each other by the same angle resulting in an improved print quality.

Also, as shown in FIG. 5 of the drawings, the substrate 16 has bond pads 76 arranged thereon which provide the electrical connections, via the pads 56, to the actuators 28 of the nozzle assemblies 10. These electrical connections are formed via the CMOS layer (not shown).

Figure 5B:
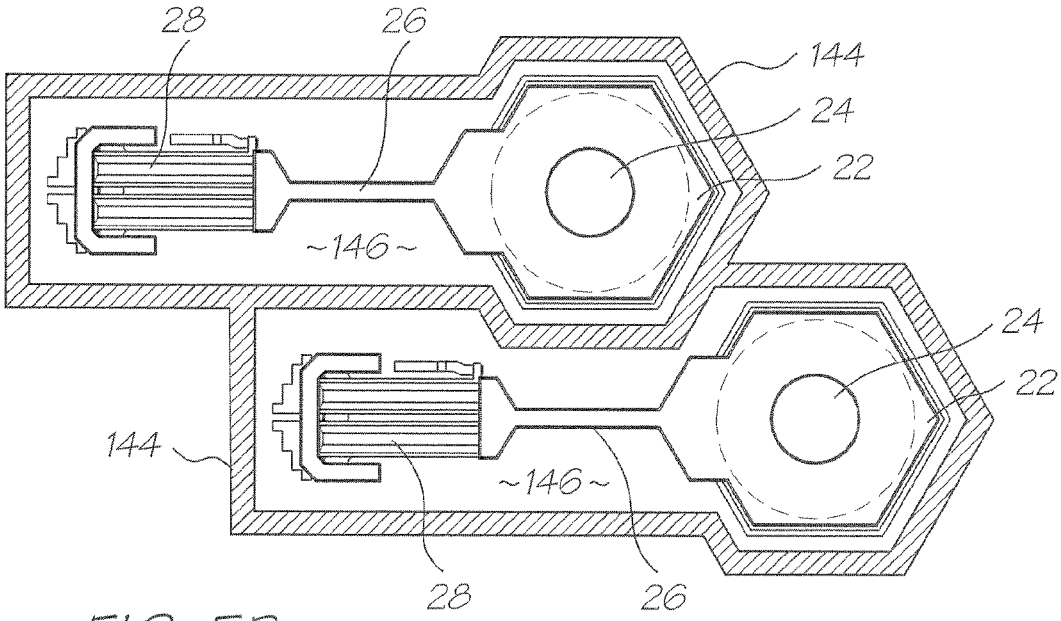
FIG. 5*b* shows a sectioned plan view of nozzles on the containment walls isolating each nozzle.
Figure 5A:
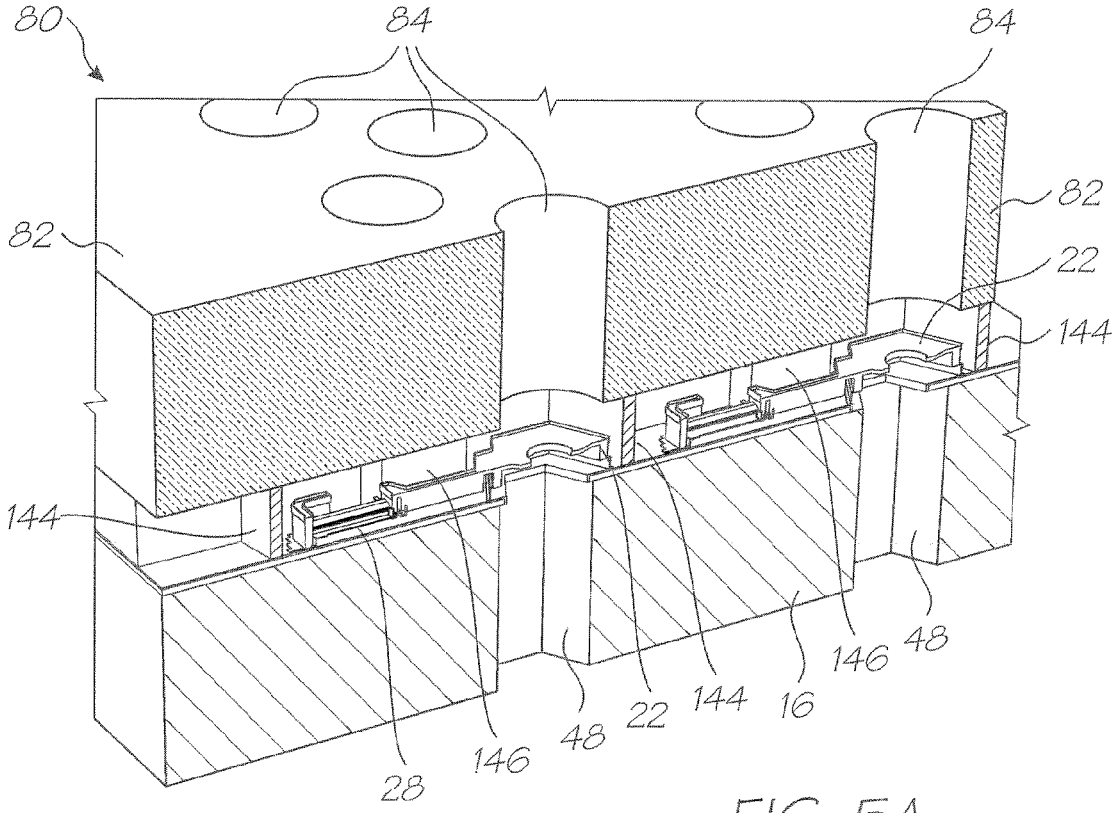
FIG. 5*a* shows a three dimensional sectioned view of a printhead according to the present invention with a nozzle guard and containment walls.
Figure 9A:
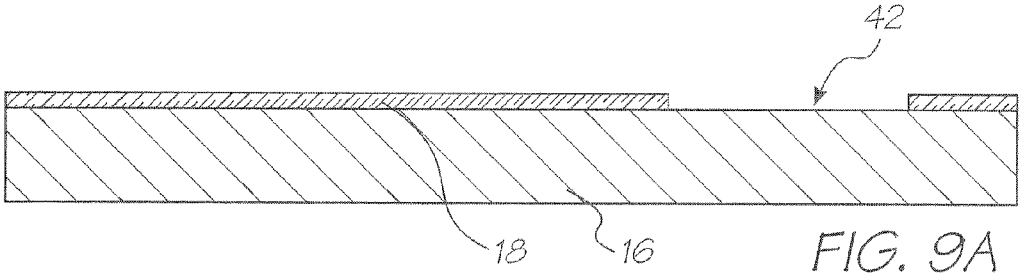
FIGS. 9*a* to 9*r* show sectional side views of the manufacturing steps.
Figure 10A:
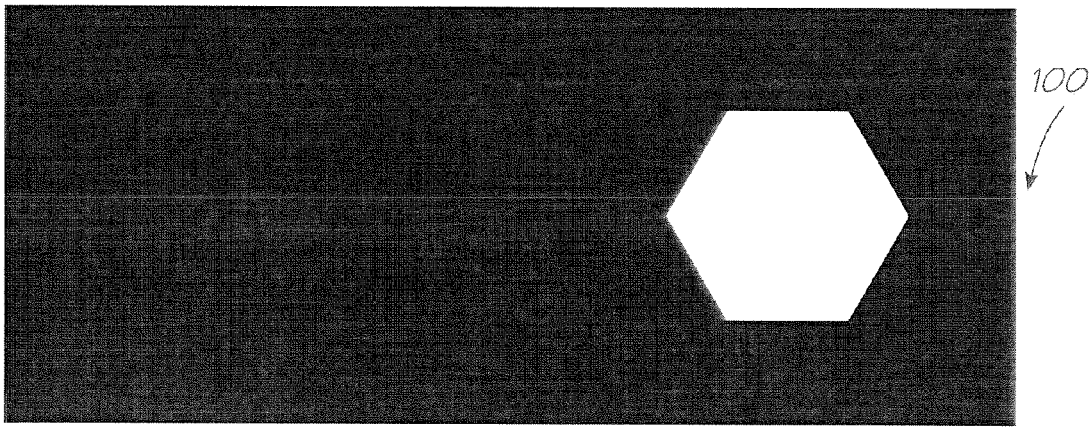
FIGS. 10*a* to 10*k* show layouts of masks used in various steps in the manufacturing process.
Figure 13:
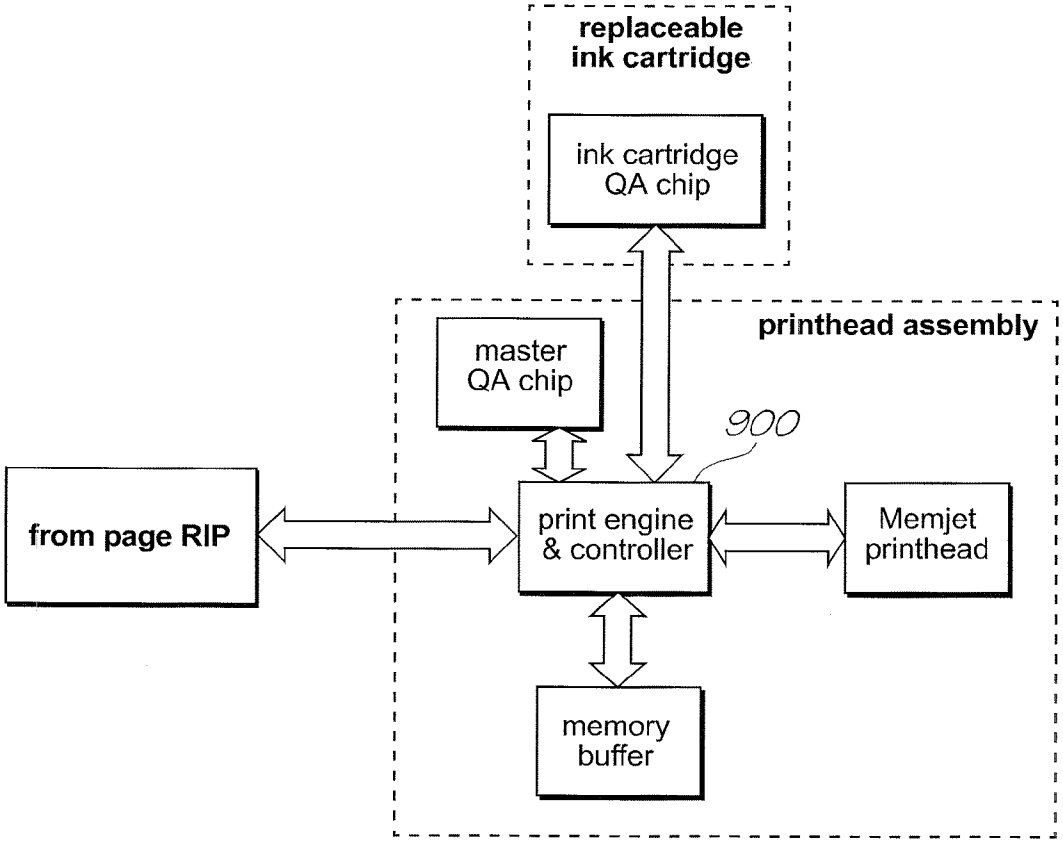
FIG. 13 illustrates a print engine and controller of the disclosed invention.

Referring to FIGS. 5*a* and 5*b*, the nozzle array 14 shown in FIG. 5 has been spaced to accommodate a containment formation surrounding each nozzle assembly 10. The containment formation is a containment wall 144 surrounding the nozzle 22 and extending from the silicon substrate 16 to the underside of an apertured nozzle guard 80 to form a containment chamber 146. If ink is not properly ejected because of nozzle damage, the leakage is confined so as not to affect the function of surrounding nozzles. Leakage in each containment chamber 146 is detected by monitoring the power required to eject an ink drop 64 from the nozzle openings 24. IF the containment chamber 146 is flooded with leaked or misdirected ink, the resistance to ink being ejected from the nozzle opening 24 will increase. Likewise, the energy consumed by the thermal bend actuator 28 will increase which flags a damaged nozzle assembly 10. Feedback to the printhead controller 900 (FIG. 13) can then stop further operation of the actuator 28 and supply of ink to the nozzle assembly 10. Using a fault tolerance facility, the damaged nozzle can be compensated for by the remaining nozzles in the array 14 thereby maintaining print quality. Referring to FIG. 9I, the CMOS passivation layer 20 has a free end extending upwardly from the wafer substrate 16.

The containment walls 144 necessarily occupy a proportion of the silicon substrate 16 which decreases the nozzle packing density of the array. This in turn increases the production costs of the printhead chip. However where the manufacturing techniques result in a relatively high nozzle attrition rate, individual nozzle containment formations will avoid, or at least minimize any adverse effects to the print quality.

It will be appreciated by those in the art, that the containment formation could also be configured to isolate groups of nozzles. Isolating groups of nozzles provides a better nozzle packing density but compensating for damaged nozzles using the surrounding nozzle groups is more difficult.

Figure 7:
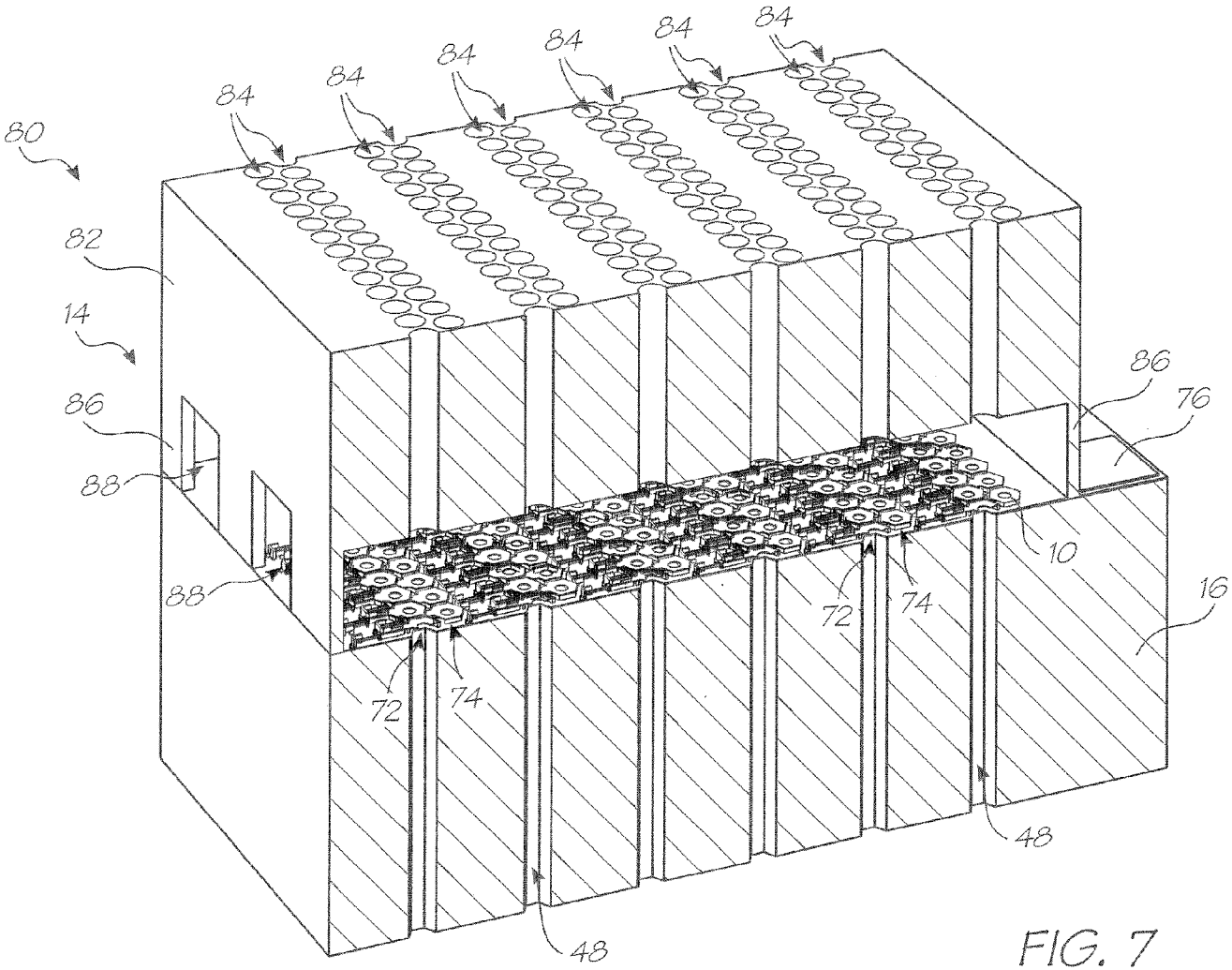
FIG. 7 shows a three dimensional view of an inkjet printhead including a nozzle guard without the containment walls.

Referring to FIG. 7, a nozzle array and a nozzle guard without containment walls is shown. With reference to the previous drawings, like reference numerals refer to like parts, unless otherwise specified.

A nozzle guard 80 is mounted on the silicon substrate 16 of the array 14. The nozzle guard 80 includes a shield 82 having a plurality of apertures 84 defined therethrough. The apertures 84 are in registration with the nozzle openings 24 of the nozzle assemblies 10 of the array 14 such that, when ink is ejected from any one of the nozzle openings 24, the ink passes through the associated passage before striking the print media.

The guard 80 is silicon so that it has the necessary strength and rigidity to protect the nozzle array 14 from damaging contact with paper, dust or the users' fingers. By forming the guard from silicon, its coefficient of thermal expansion substantially matches that of the nozzle array. This aims to prevent the apertures 84 in the shield 82 from falling out of register with the nozzle array 14 as the printhead heats up to its normal operating temperature. Silicon is also well suited to accurate micro-machining using MEMS techniques discussed in greater detail below in relation to the manufacture of the nozzle assemblies 10.

The shield 82 is mounted in spaced relationship relative to the nozzle assemblies 10 by limbs or struts 86. One of the struts 86 has air inlet openings 88 defined therein.

In use, when the array 14 is in operation, air is charged through the inlet openings 88 to be forced through the apertures 84 together with ink travelling through the apertures 84.

The ink is not entrained in the air as the air is charged through the apertures 84 at a different velocity from that of the ink droplets 64. For example, the ink droplets 64 are ejected from the nozzles 22 at a velocity of approximately 3 m/s. The air is charged through the apertures 84 at a velocity of approximately 1 m/s.

The purpose of the air is to maintain the apertures 84 clear of foreign particles. A danger exists that these foreign particles, such as dust particles, could fall onto the nozzle assemblies 10 adversely affecting their operation. With the provision of the air inlet openings 88 in the nozzle guard 80 this problems is, to a large extent, obviated.

Figure 7A:
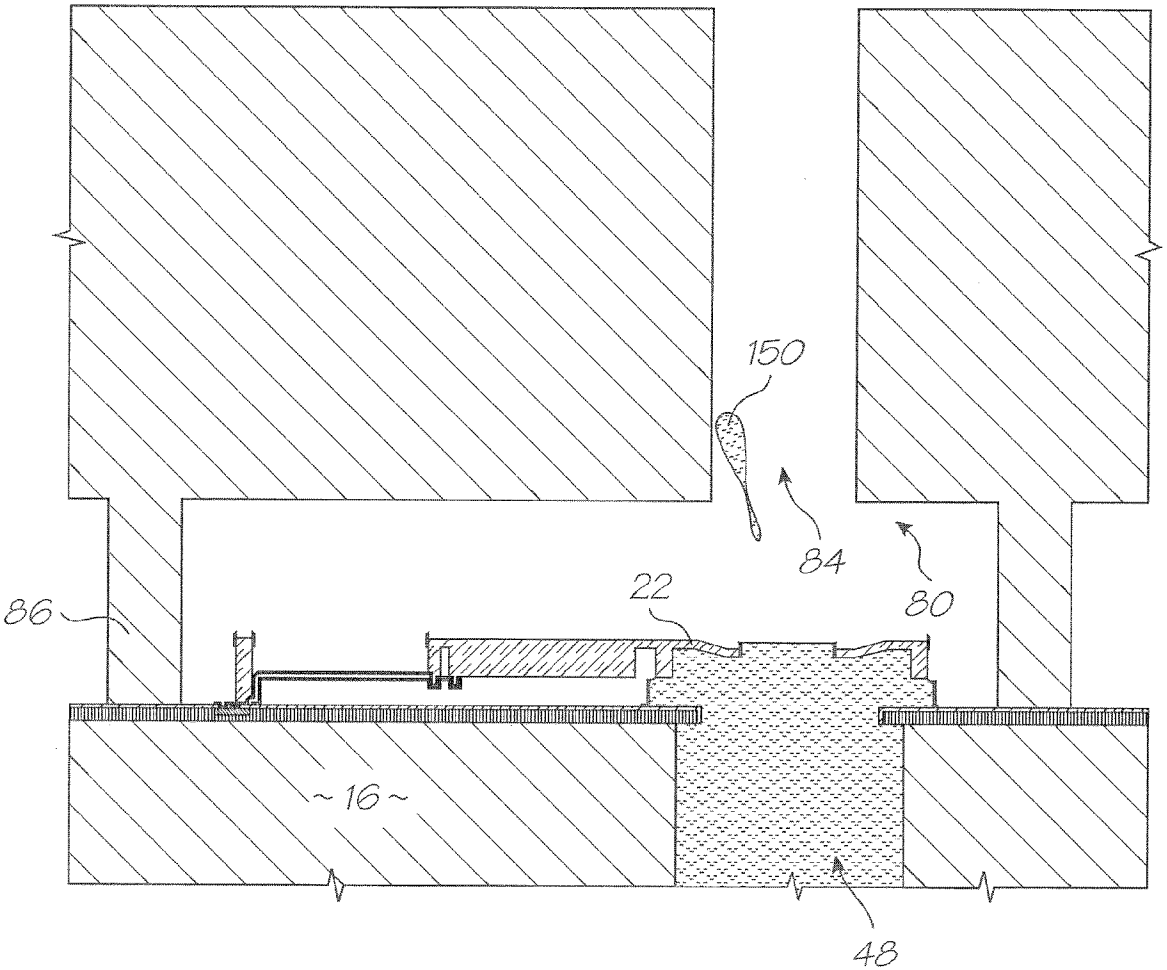
Figure 7B:
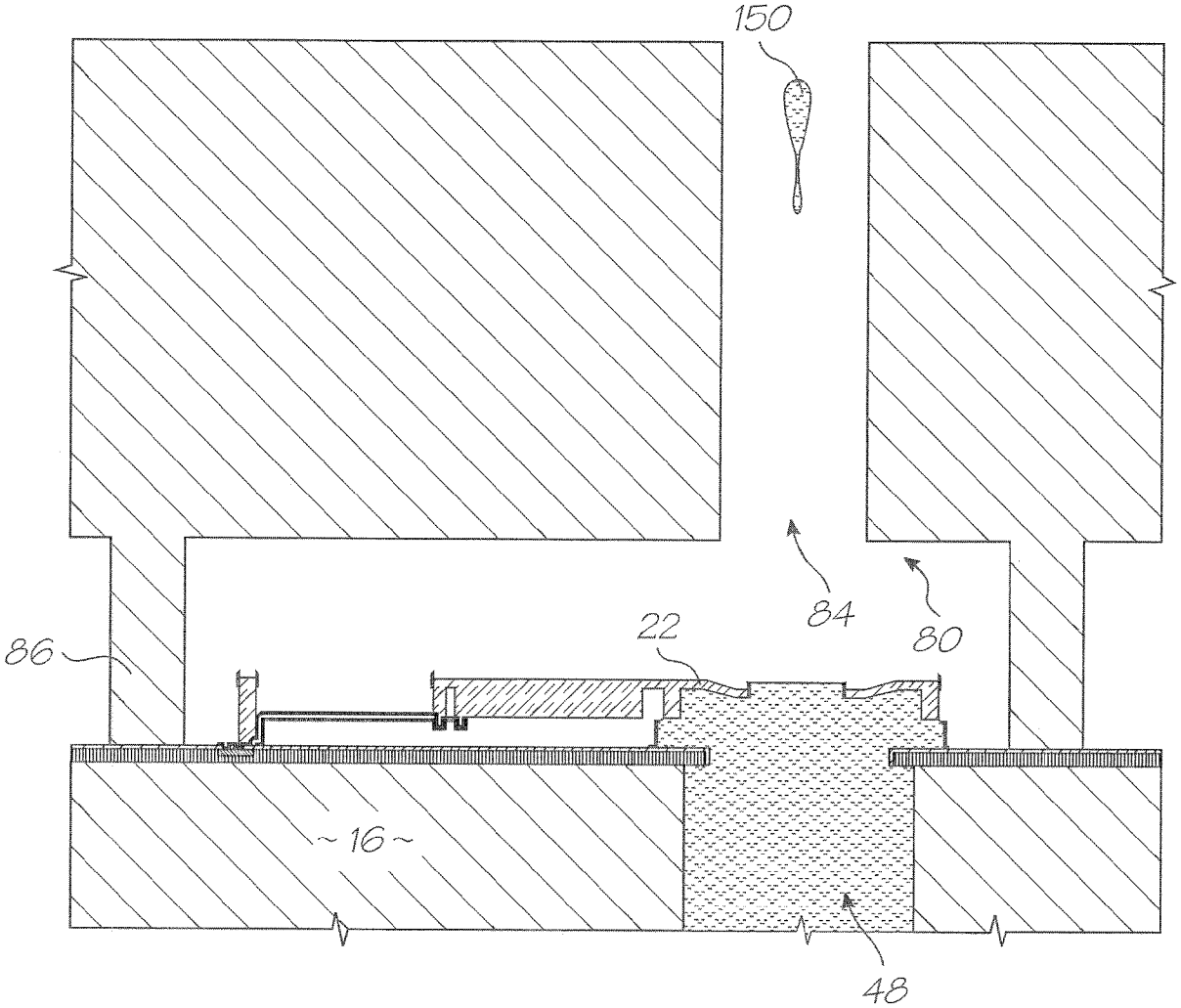
Figure 8A:
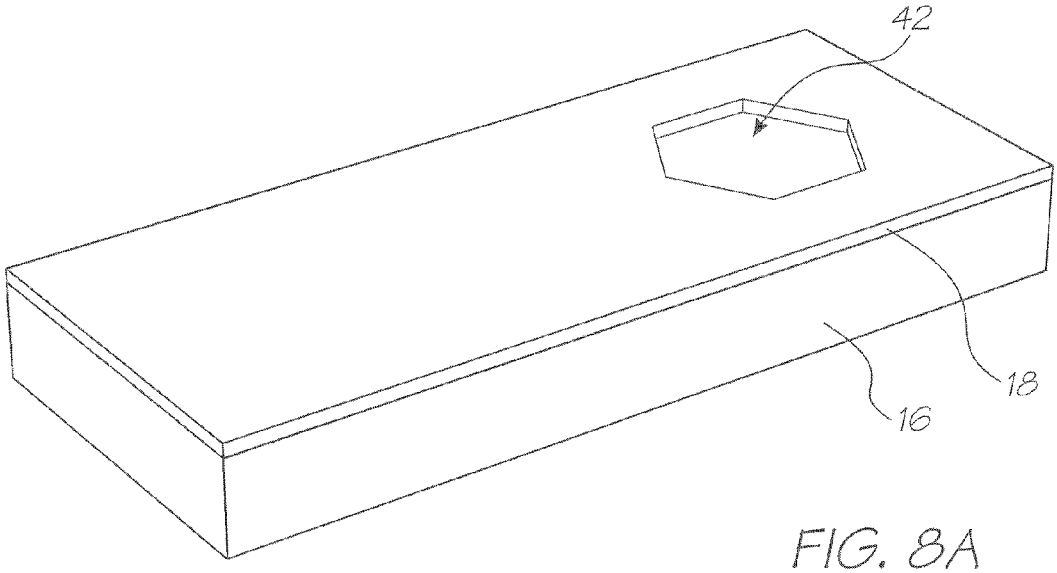
FIGS. 8*a* to 8*r* show three dimensional views of steps in the manufacture of a nozzle assembly of an ink jet printhead.

If a foreign particle does adhere to the nozzle assembly, the ejected ink may be misdirected. Similarly, inaccurate nozzle formation during manufacture can also result in misdirected ink droplets. As shown in FIGS. 7*a* and 7*b*, apertures 84 in the nozzle guard 80 can be used as collimators to retain misdirected ink droplets. By careful alignment of the guard apertures 84 with respective nozzles 22, ink from damaged nozzles 22 is collected by the guard 80 and prevented from reaching the media. FIG. 7*a* shows a misdirected ink droplet 150 ejected from a damaged nozzle assembly 10. As the droplet 150 strays from the intended ink trajectory, it collides and adheres to the side wall of the guard aperture 84. FIG. 7*b* shows an undamaged nozzle assembly 10 ejecting an ink droplet 150 along the intended trajectory towards the media to be printed without obstruction from the guard 80.

The containment walls 144 shown in FIGS. 5*a* and 5*b* can be used to prevent the accumulation of misdirected ink from affecting the operation of any of the surrounding nozzles. Again, a detection sensor discussed above in relation to the containment walls, would sense the presence of ink in the containment chamber 146 and provide feedback to the microprocessor controlling the printhead which in turn stops ink supply to the damaged nozzle. To maintain print quality, a fault tolerance facility adjusts the operation of other nozzles 22 in the array 14 to compensate for the damaged nozzle 22.

Referring now to FIGS. 8 to 10 of the drawings, a process for manufacturing the nozzle assemblies 10 is described.

Starting with the silicon substrate or wafer 16, the dielectric layer 18 is deposited on a surface of the wafer 16. The dielectric layer 18 is in the form of approximately 1.5 microns of CVD oxide. Resist is spun on to the layer 18 and the layer 18 is exposed to mask 100 and is subsequently developed.

After being developed, the layer 18 is plasma etched down to the silicon layer 16. The resist is then stripped and the layer 18 is cleaned. This step defines the ink inlet aperture 42.

Figure 8B:
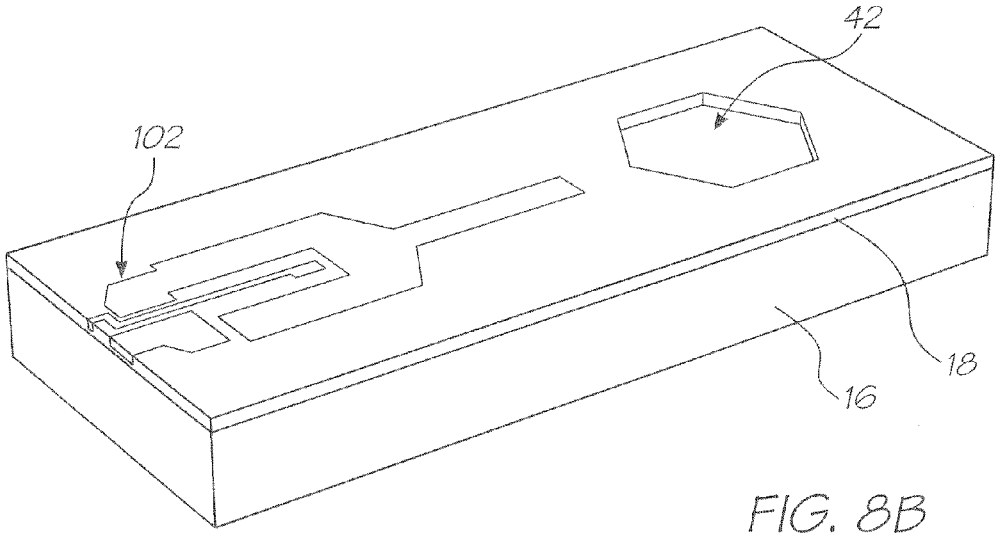
Figure 9B:
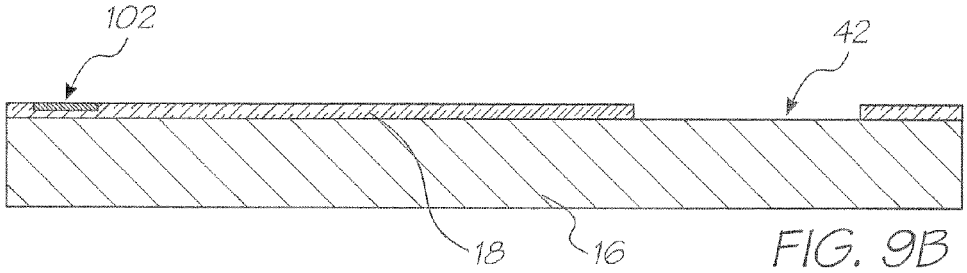
Figure 10B:
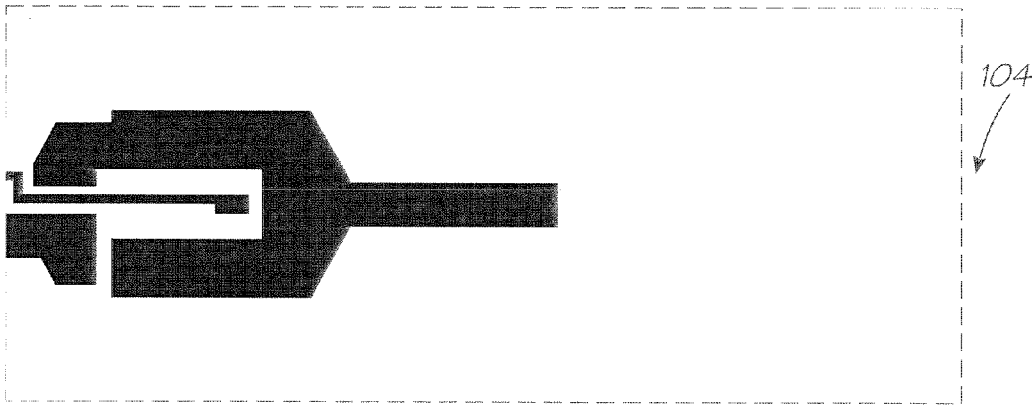
Figure 8C:
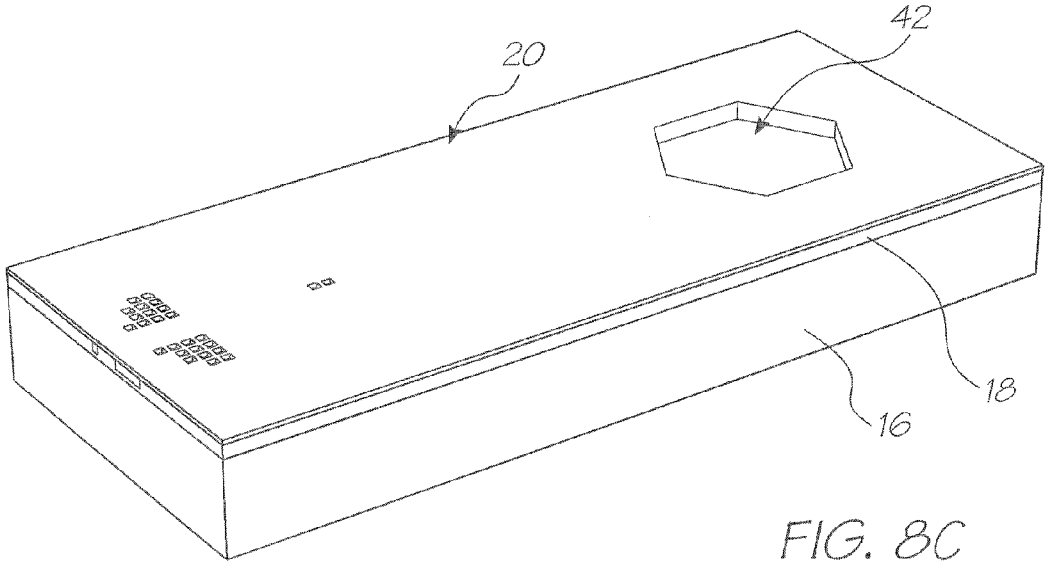
Figure 9C:
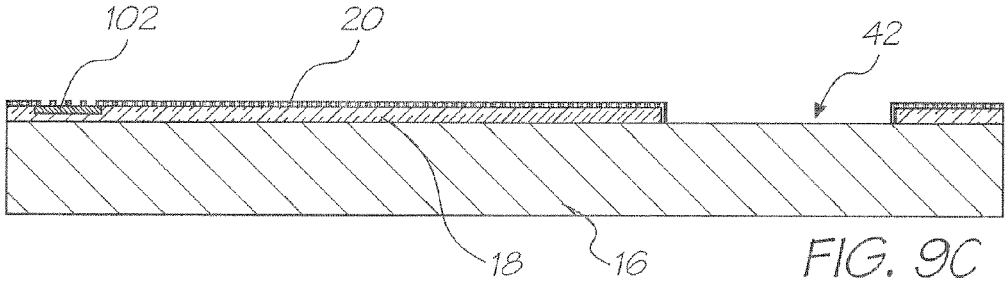
Figure 10C:
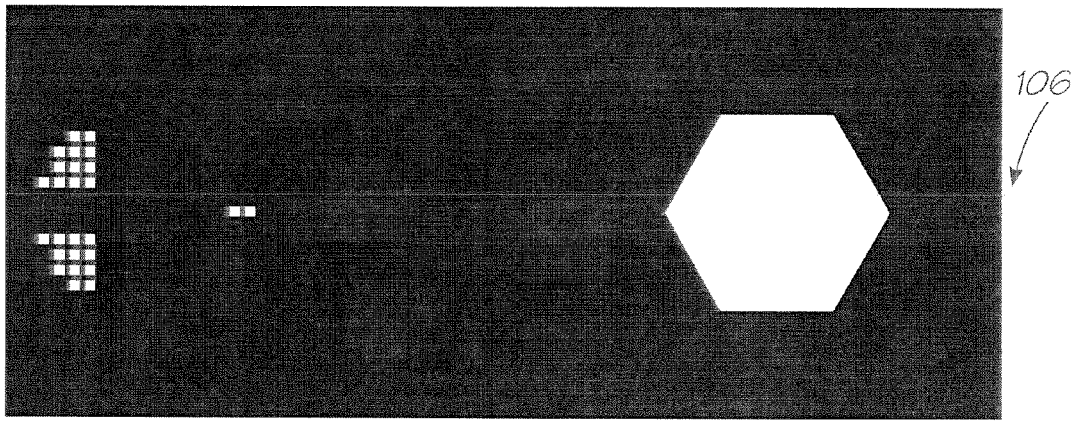
Figure 8D:
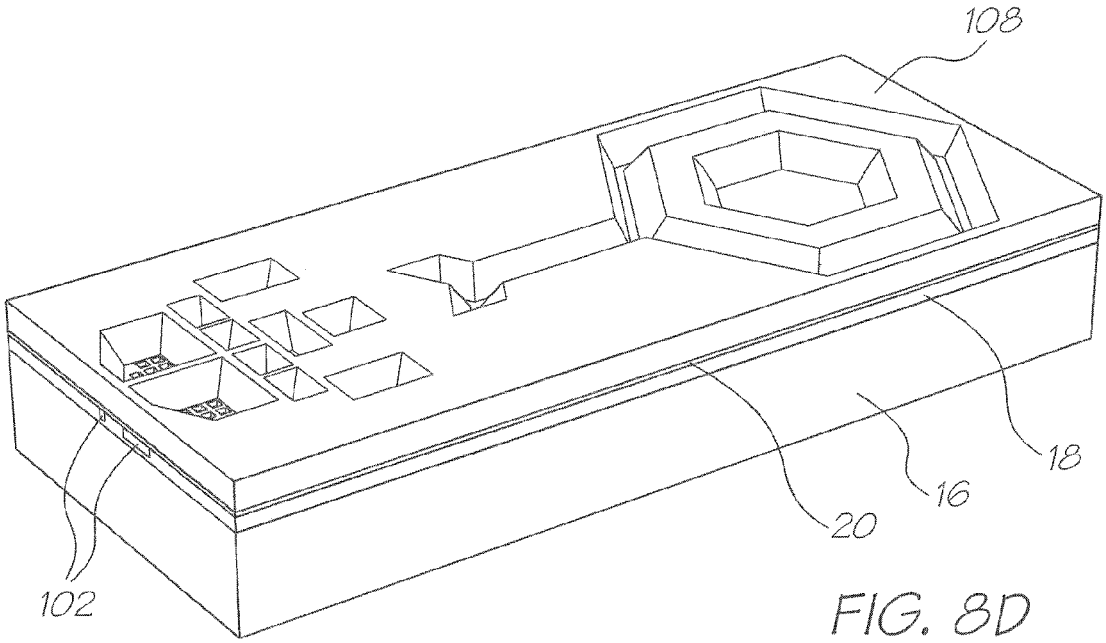
Figure 9D:
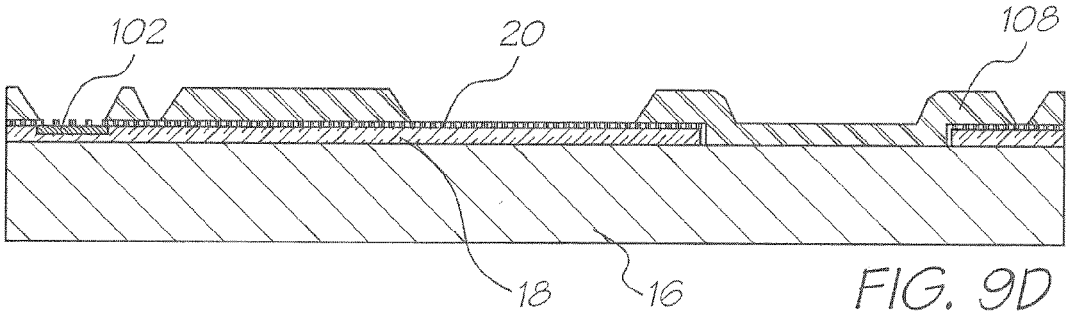
Figure 10D:
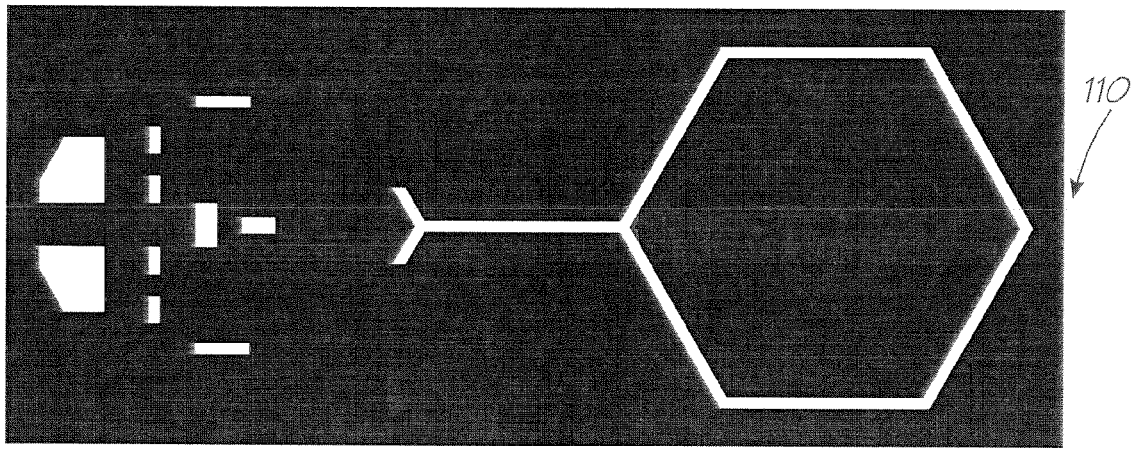

In FIG. 8*b* of the drawings, approximately 0.8 microns of aluminum 102 is deposited on the layer 18. Resist is spun on and the aluminum 102 is exposed to mask 104 and developed. The aluminum 102 is plasma etched down to the oxide layer 18, the resist is stripped and the device is cleaned. This step provides the bond pads and interconnects to the ink jet actuator 28. This interconnect is to an NMOS drive transistor and a power plane with connections made in the CMOS layer (not shown).

Approximately 0.5 microns of PECVD nitride is deposited as the CMOS passivation layer 20. Resist is spun on and the layer 20 is exposed to mask 106 whereafter it is developed. After development, the nitride is plasma etched down to the aluminum layer 102 and the silicon layer 16 in the region of the inlet aperture 42. The resist is stripped and the device cleaned.

A layer 108 of a sacrificial material is spun on to the layer 20. The layer 108 is 6 microns of photo-sensitive polyimide or approximately 4 μm of high temperature resist. The layer 108 is softbaked and is then exposed to mask 110 whereafter it is developed. The layer 108 is then hardbaked at 400° C. for one hour where the layer 108 is comprised of polyimide or at greater than 300° C. where the layer 108 is high temperature resist. It is to be noted in the drawings that the pattern-dependent distortion of the polyimide layer 108 caused by shrinkage is taken into account in the design of the mask 110.

Figure 8E:
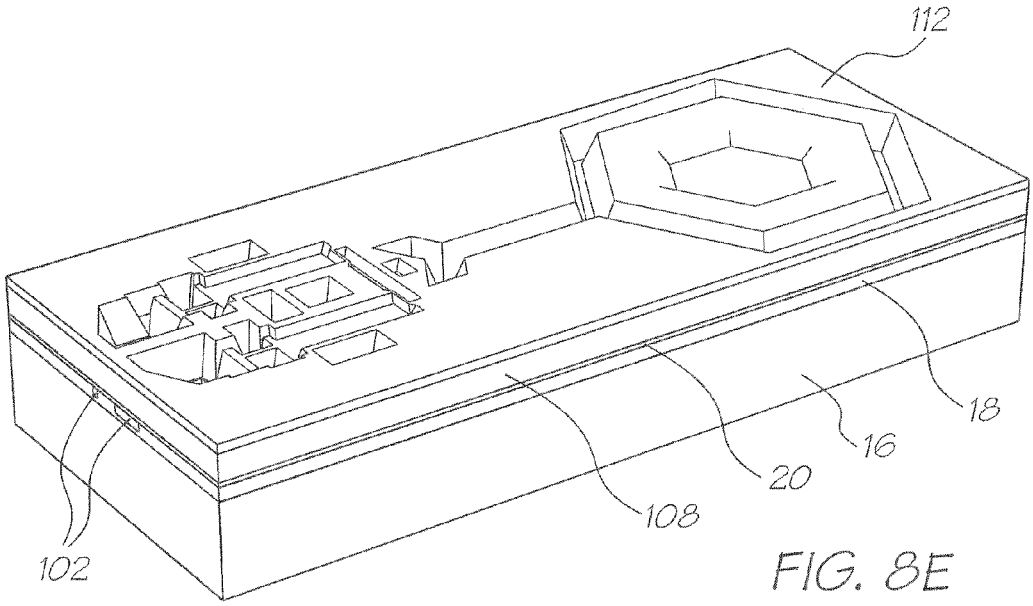
Figure 10E:
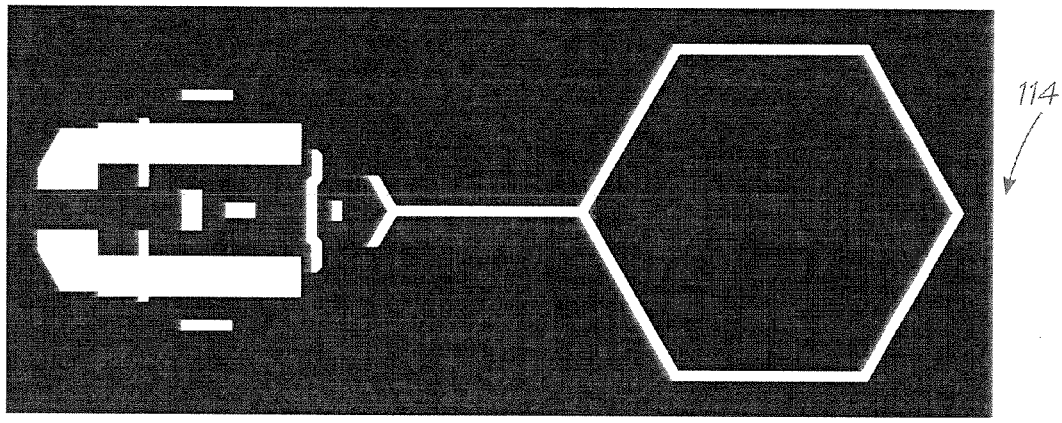
Figure 8F:
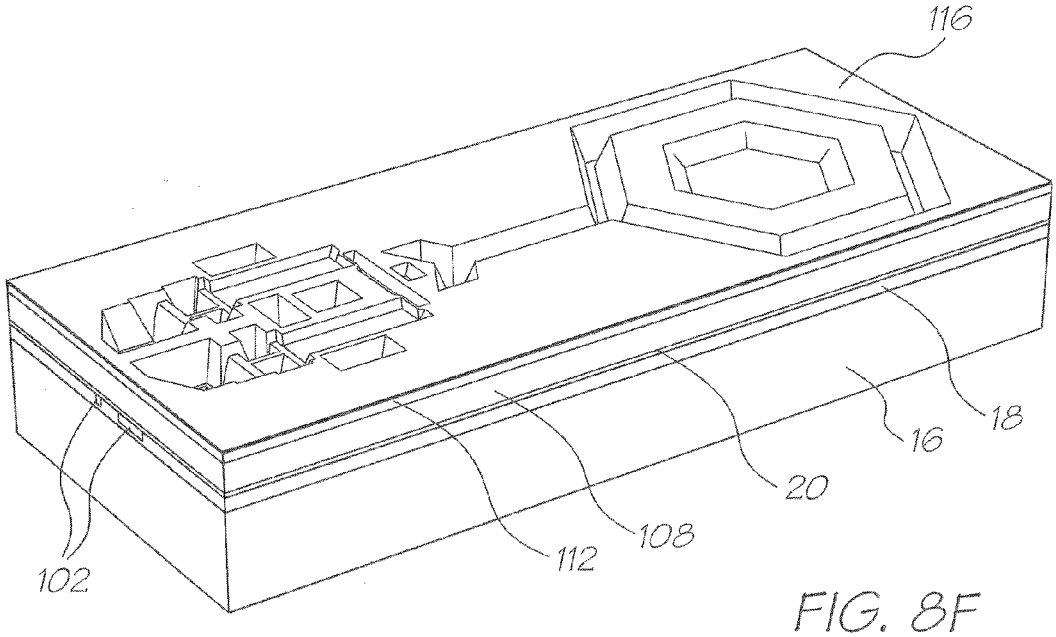
Figure 8G:
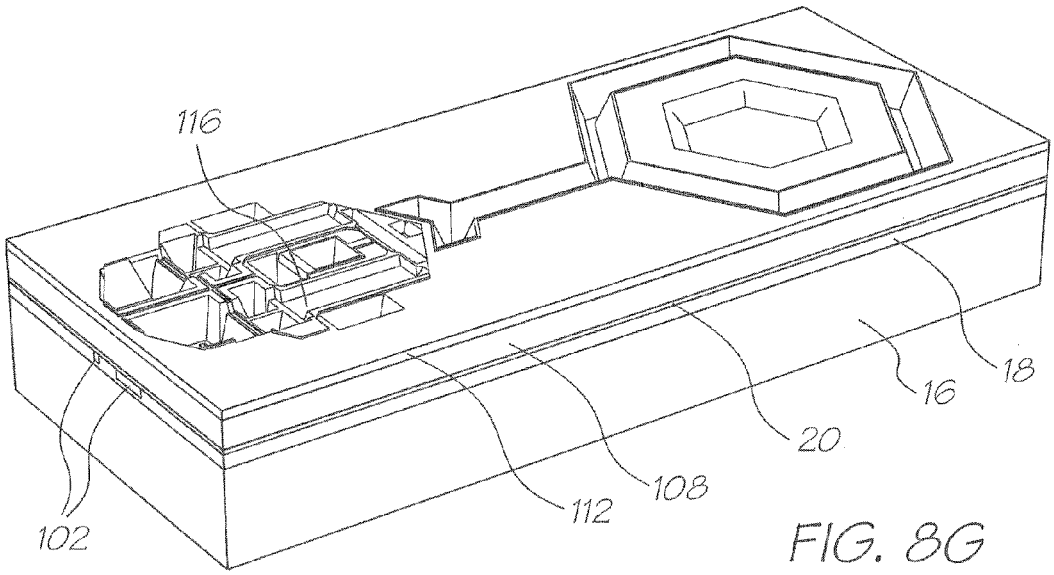
Figure 10F:
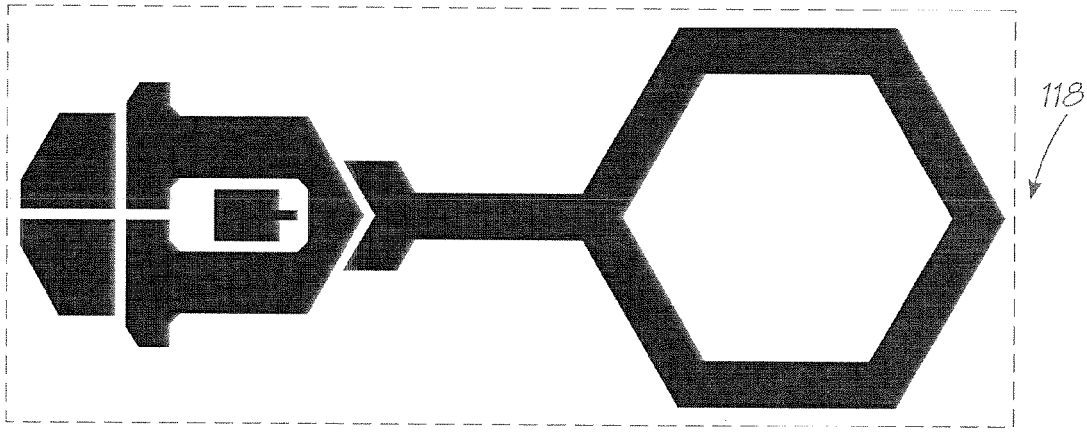
Figure 8H:
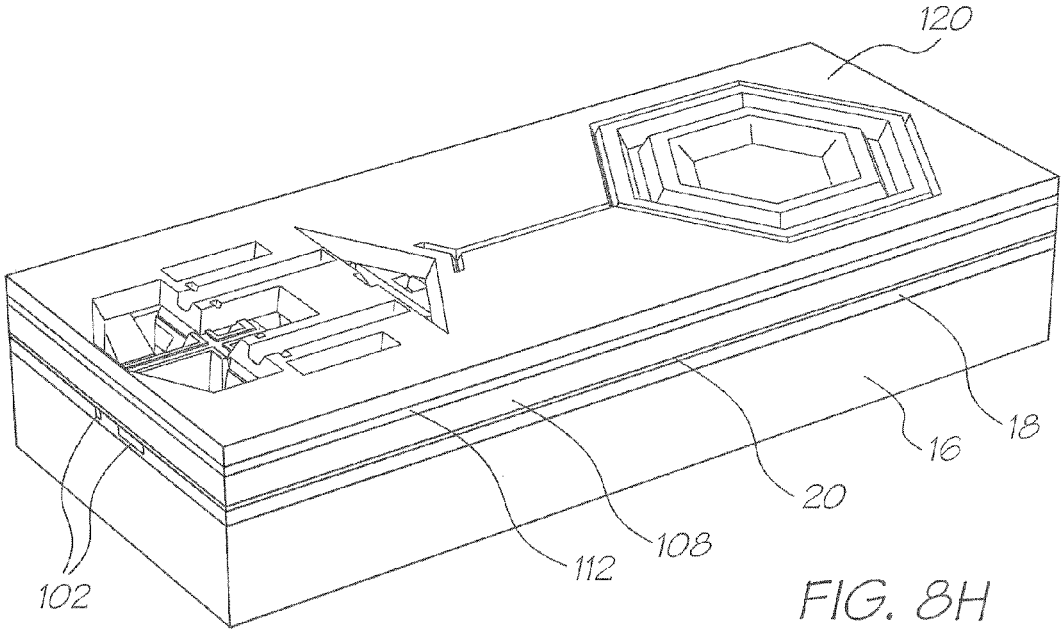
Figure 10G:
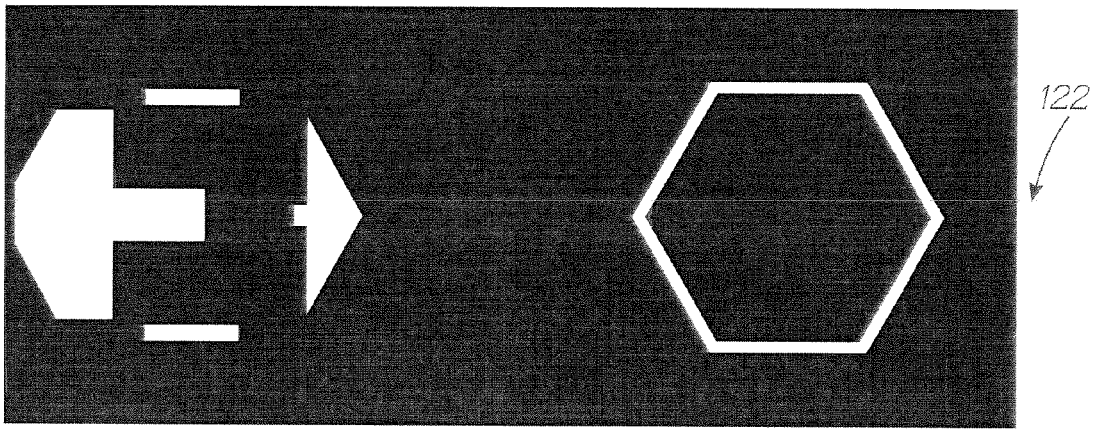
Figure 81:
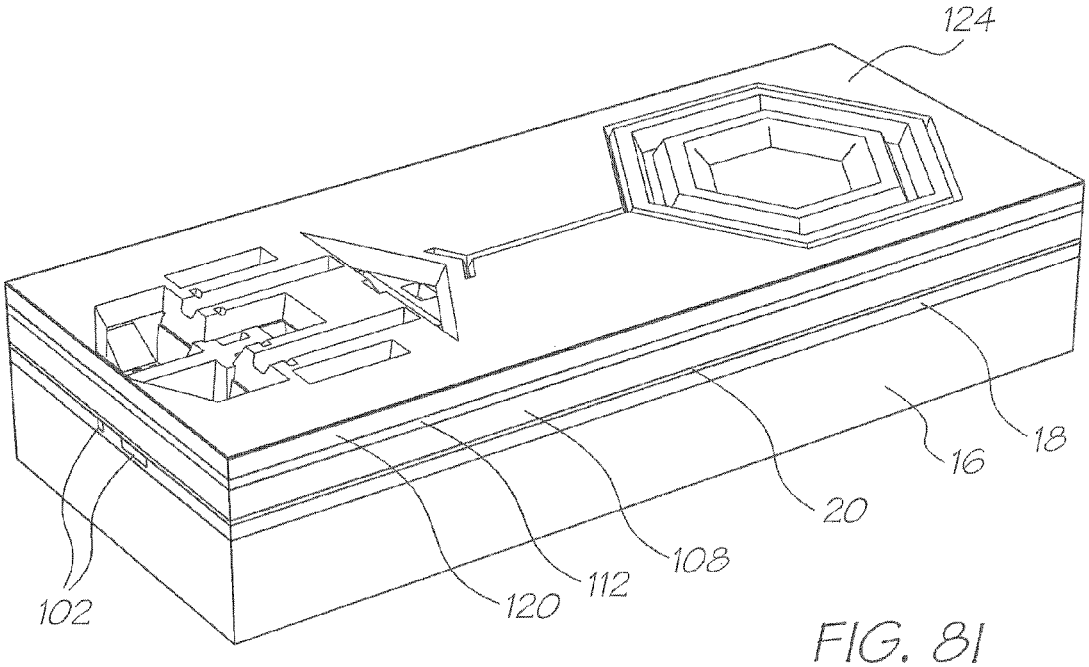
Figure 91:
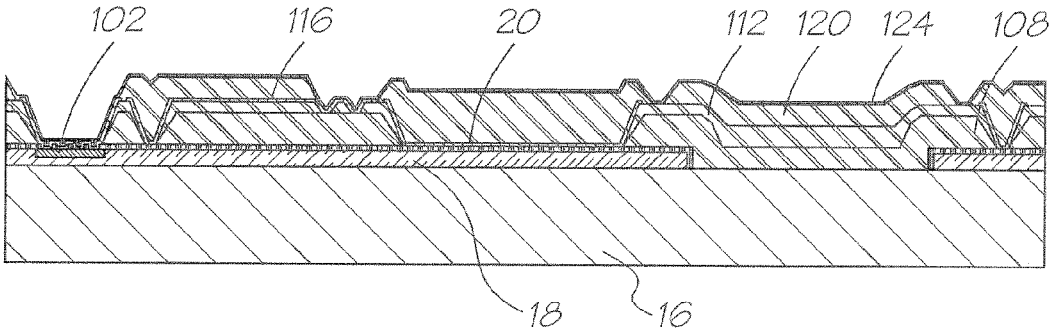
Figure 8J:
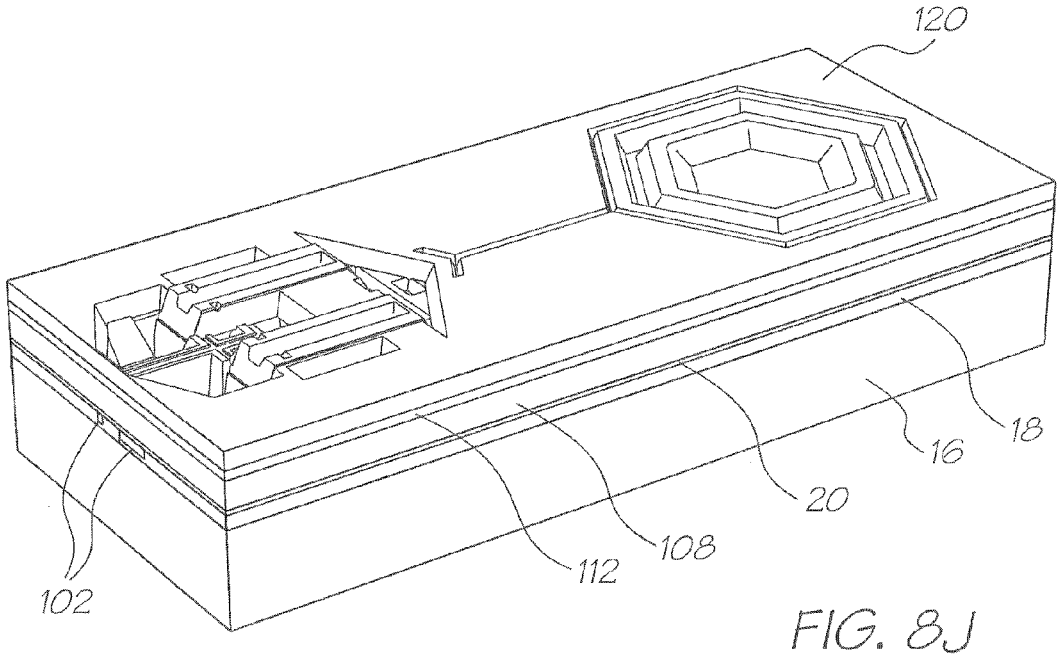
Figure 10H:
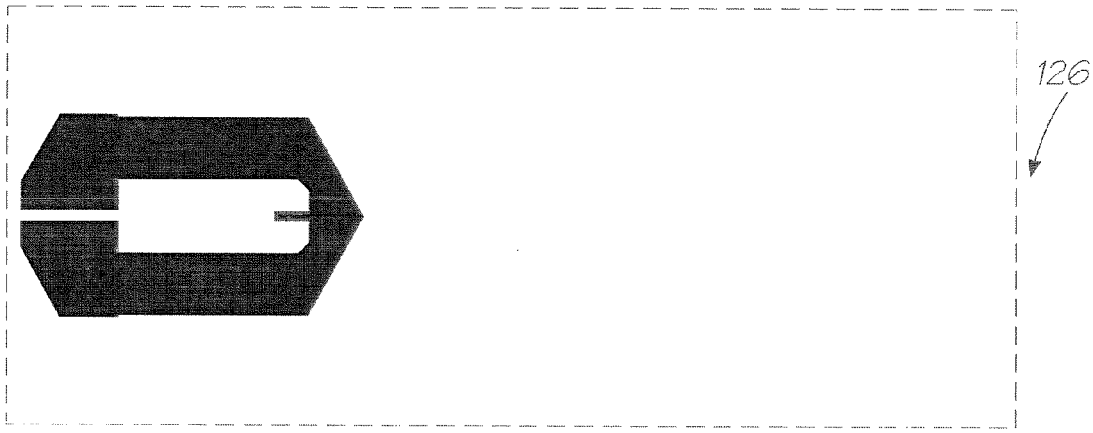
Figure 8K:
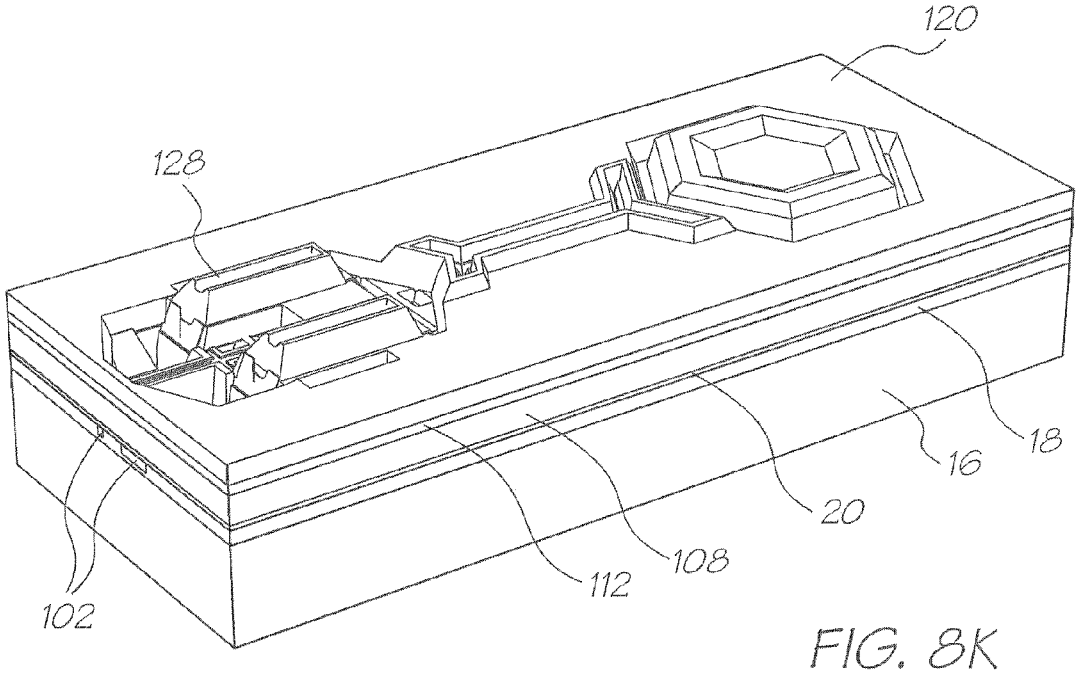

In the next step, shown in FIG. 8*e* of the drawings, a second sacrificial layer 112 is applied. The layer 112 is either 2 μm of photo-sensitive polyimide which is spun on or approximately 1.3 μm of high temperature resist. The layer 112 is softbaked and exposed to mask 114. After exposure to the mask 114, the layer 112 is developed. In the case of the layer 112 being polyimide, the layer 112 is hardbaked at 400° C. for approximately one hour. Where the layer 112 is resist, it is hardbaked at greater than 300° C. for approximately one hour.

At 0.2 micron multi-layer metal layer 116 is then deposited. Part of this layer 116 forms the passive beam 60 of the actuator 28.

The layer 116 is formed by sputtering 1,000 Å of titanium nitride (TiN) at around 300° C. followed by sputtering 50 Å of tantalum nitride (TaN). A further 1,000 Å of TiN is sputtered on followed by 50 Å of TaN and a further 1,000 Å of TiN. Other materials which can be used instead of TiN are $TiB_2$, $MoSi_2$ or (Ti, Al)N.

The layer 116 is then exposed to mask 118, developed and plasma etched down to the layer 112 whereafter resist, applied for the layer 116, is wet stripped taking care not to remove the cured layers 108 or 112.

A third sacrificial layer 120 is applied by spinning on 4 μm of photo-sensitive polyimide or approximately 2.6 μm high temperature resist. The layer 120 is softbaked whereafter it is exposed to mask 122. The exposed layer is then developed followed by hard baking. In the case of polyimide, the layer 120 is hardbaked at 400° C. for approximately one hour or at greater than 300° C. where the layer 120 comprises resist.

A second multi-layer metal layer 124 is applied to the layer 120. The constituents of the layer 124 are the same as the layer 116 and are applied in the same manner. It will be appreciated that both layers 116 and 124 are electrically conductive layers.

The layer 124 is exposed to mask 126 and is then developed. The layer 124 is plasma etched down to the polyimide or resist layer 120 whereafter resist applied for the layer 124 is wet stripped taking care not to remove the cured layers 108, 112 or 120. It will be noted that the remaining part of the layer 124 defines the active beam 58 of the actuator 28.

Figure 9E:
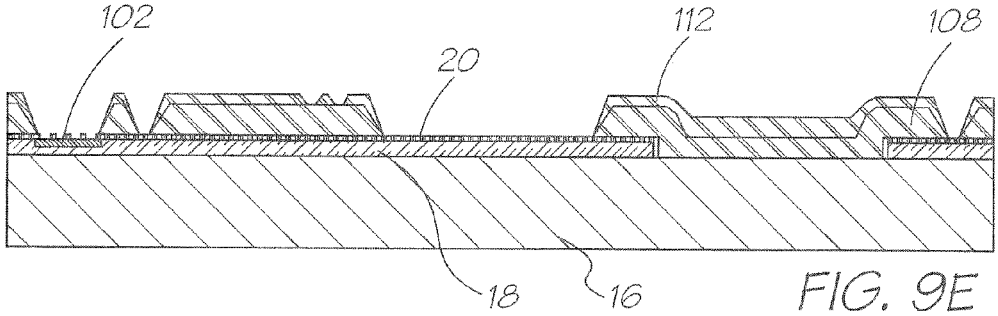
Figure 9F:
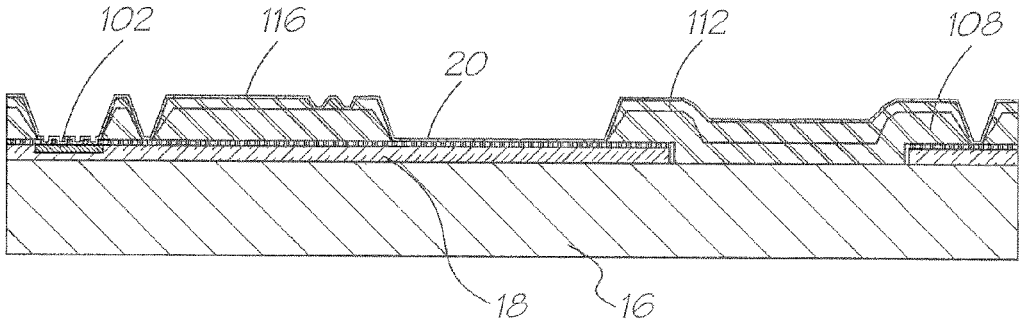
Figure 9G:
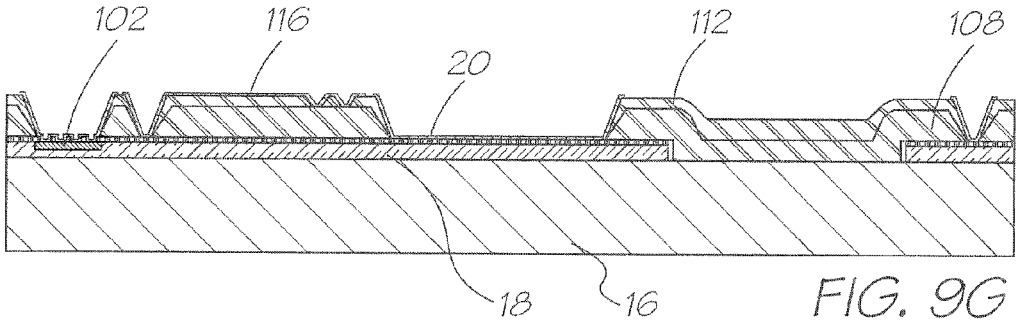
Figure 9H:
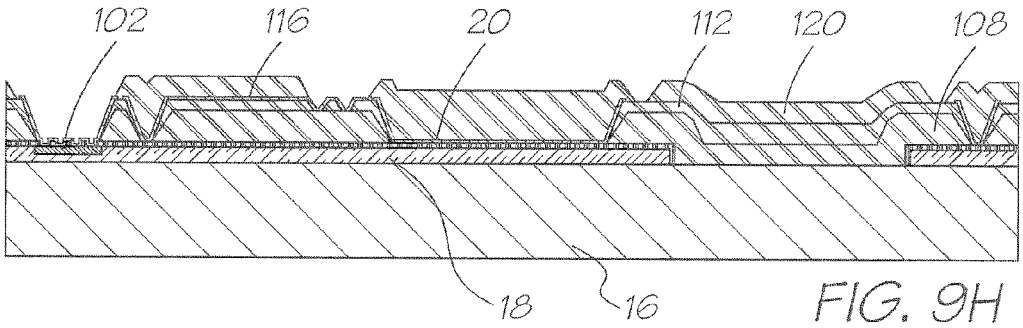
Figure 9J:
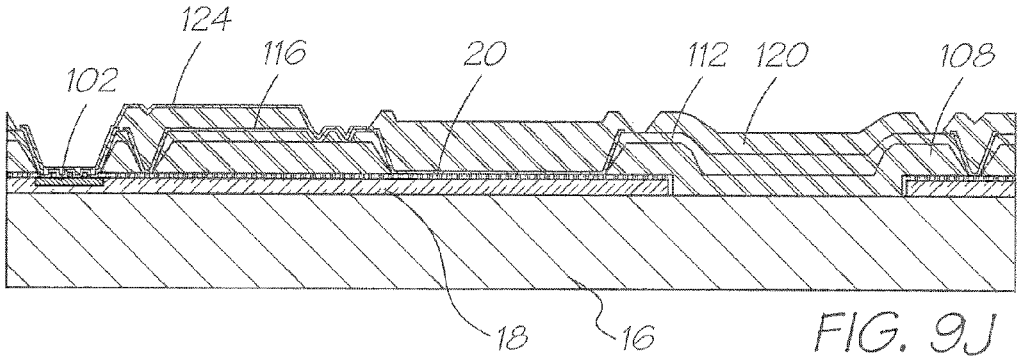
Figure 9K:
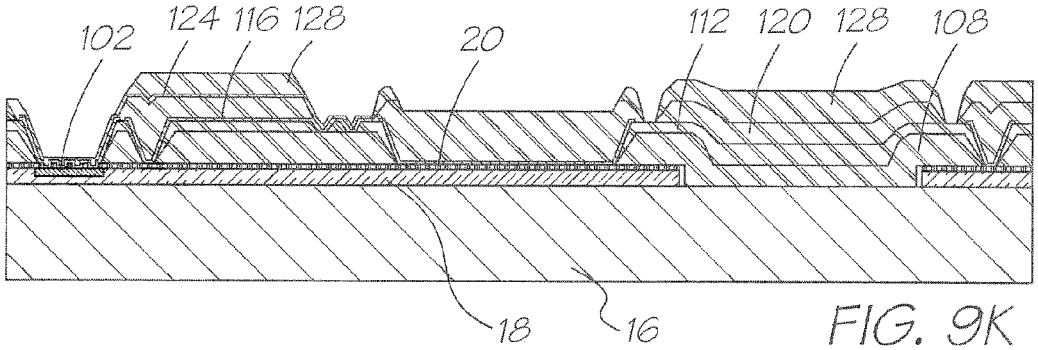
Figure 10I:
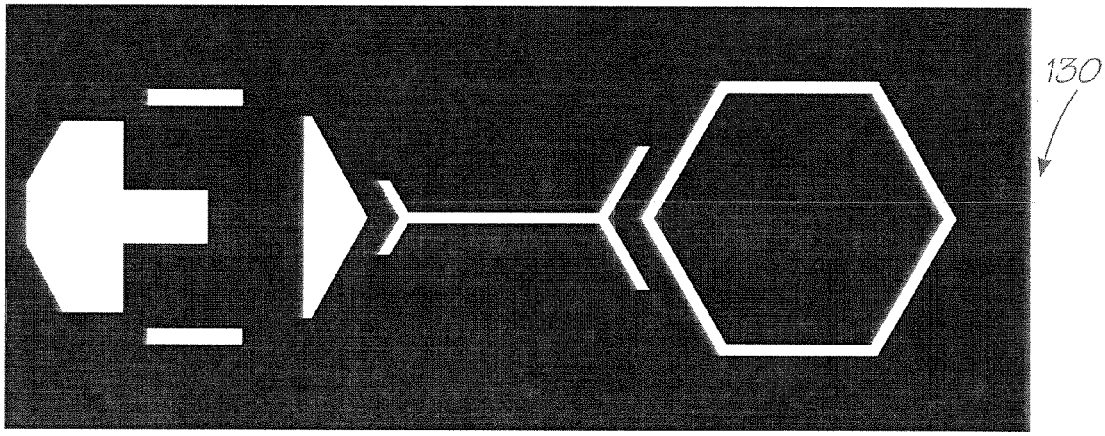

A fourth sacrificial layer 128 is applied by spinning on 4 μm of photo-sensitive polyimide or approximately 2.6 μm of high temperature resist. The layer 128 is softbaked, exposed to the mask 130 and is then developed to leave the island portions as shown in FIG. 9*k* of the drawings. The remaining portions of the layer 128 are hardbaked at 400° C. for approximately one hour in the case of polyimide or at greater than 300° C. for resist.

Figure 8L:
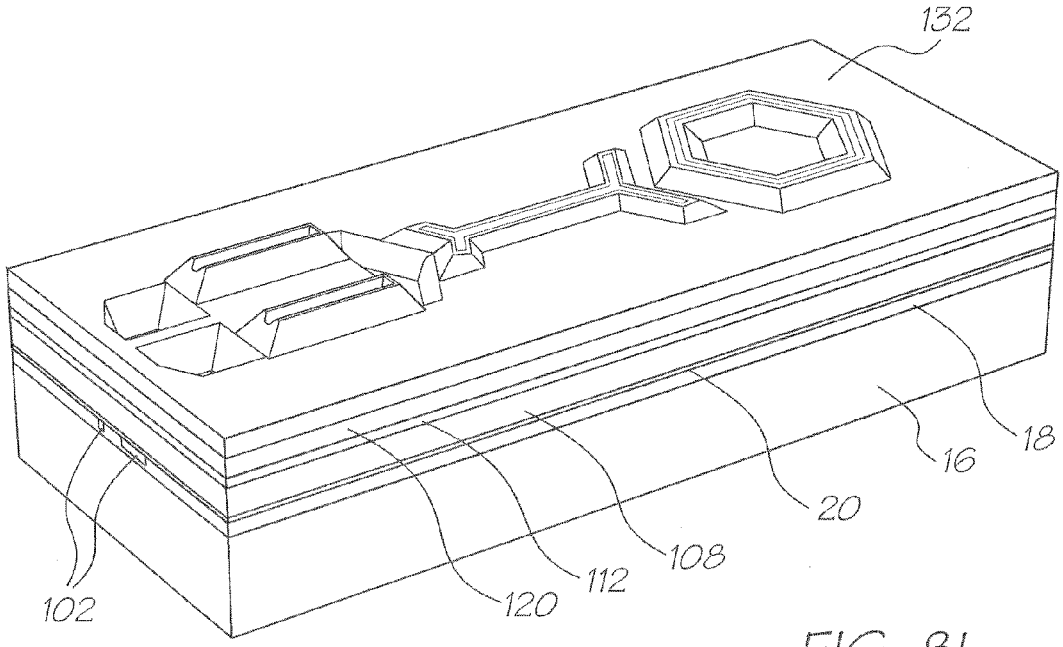
Figure 9L:
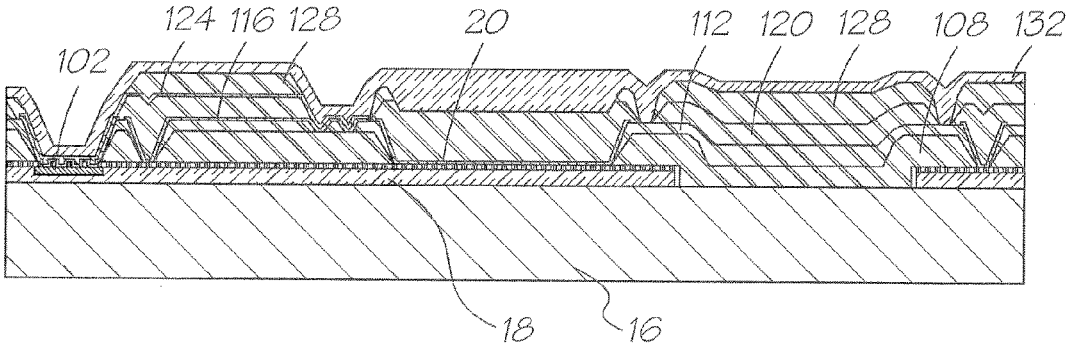
Figure 8M:
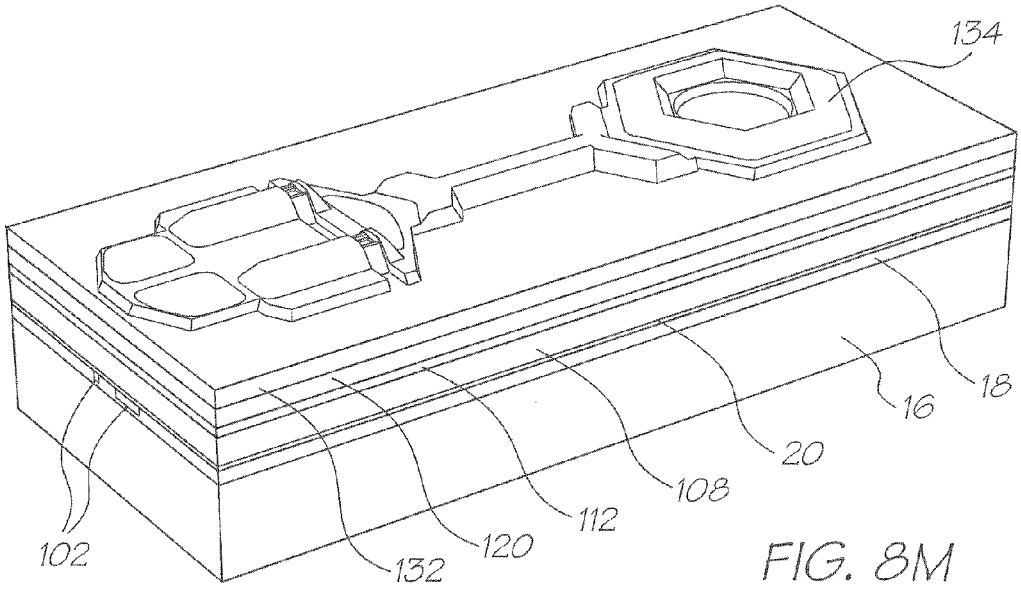
Figure 9M:
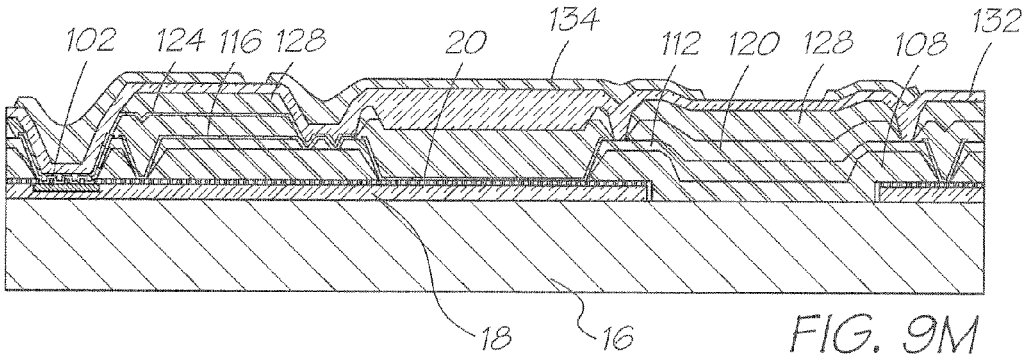
Figure 10J:
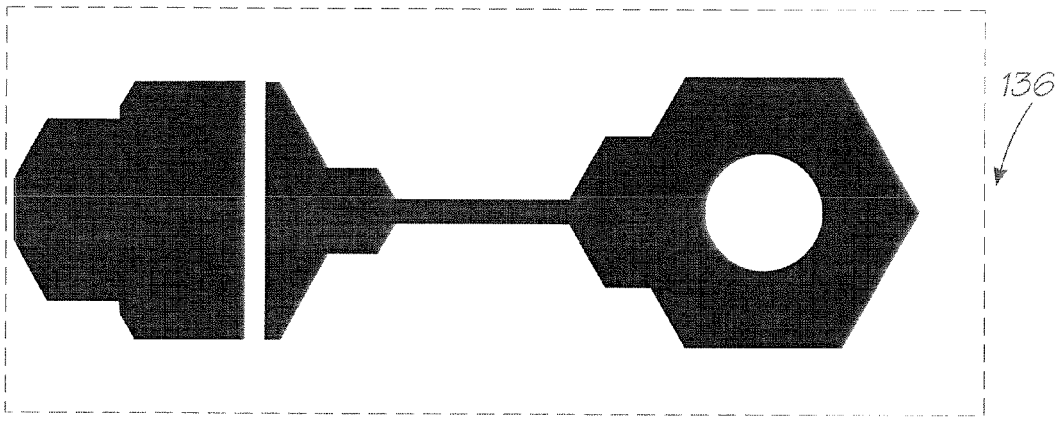
Figure 8N:
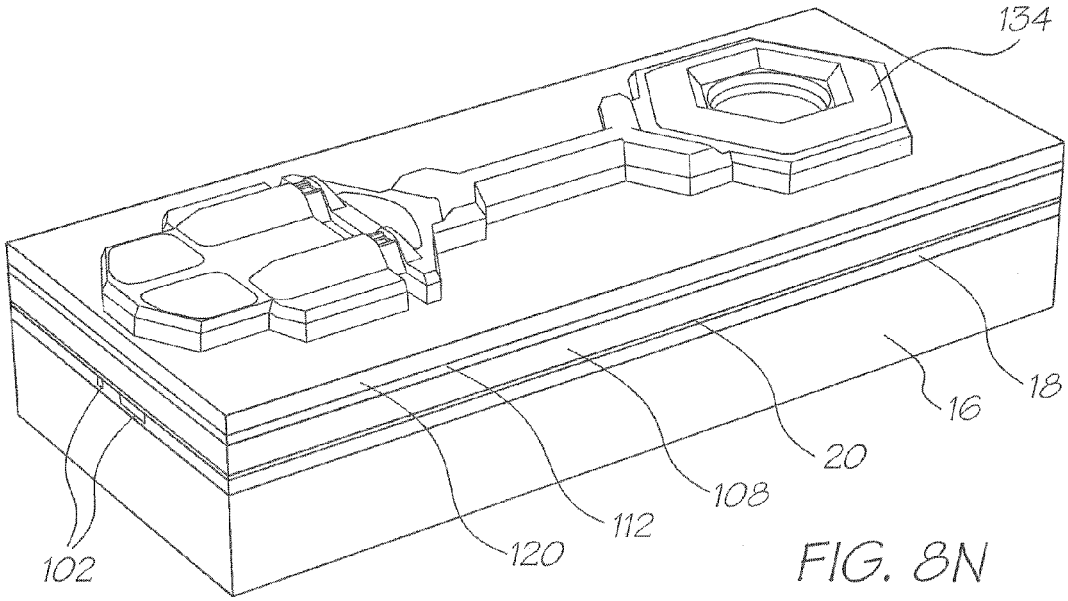
Figure 9N:
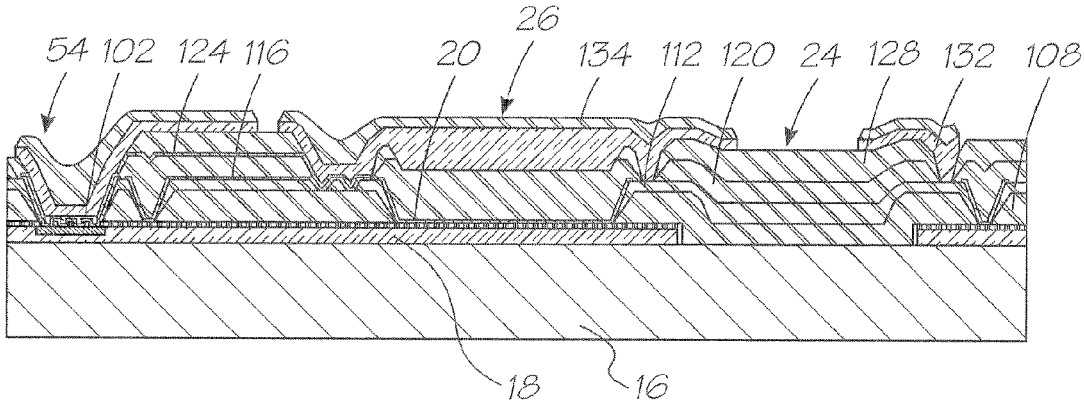
Figure 80:
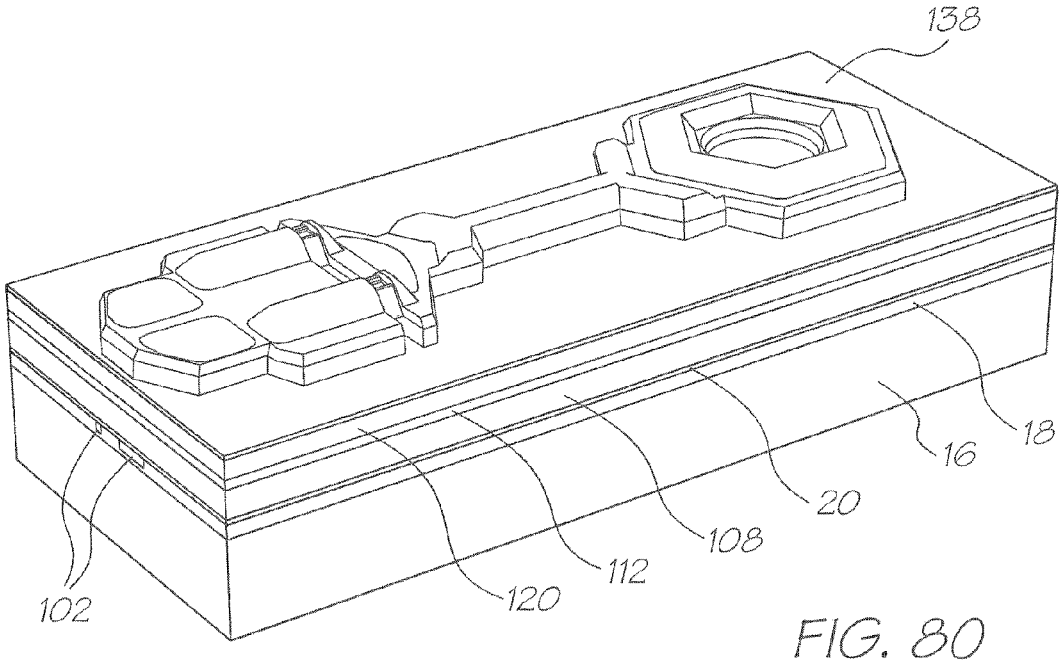
Figure 90:
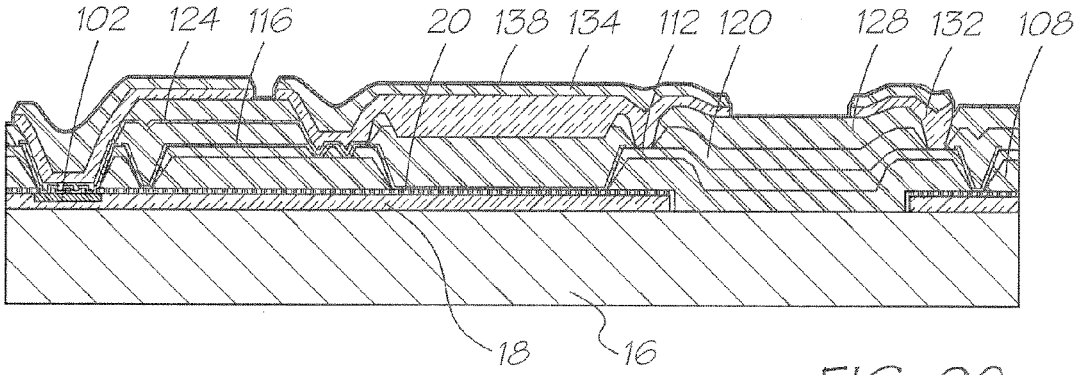

As shown in FIG. 8*l* of the drawing a high Young's modulus dielectric layer 132 is deposited. The layer 132 is constituted by approximately 1 μm of silicon nitride or aluminum oxide. The layer 132 is deposited at a temperature below the hardbaked temperature of the sacrificial layers 108, 112, 120, 128. The primary characteristics required for this dielectric layer 132 are a high elastic modulus, chemical inertness and good adhesion to TiN.

A fifth sacrificial layer 134 is applied by spinning on 2 μm of photo-sensitive polyimide or approximately 1.3 μm of high temperature resist. The layer 134 is softbaked, exposed to mask 136 and developed. The remaining portion of the layer 134 is then hardbaked at 400° C. for one hour in the case of the polyimide or at greater than 300° C. for the resist.

The dielectric layer 132 is plasma etched down to the sacrificial layer 128 taking care not to remove any of the sacrificial layer 134.

This step defines the nozzle opening 24, the lever arm 26 and the anchor 54 of the nozzle assembly 10.

A high Young's modulus dielectric layer 138 is deposited. This layer 138 is formed by depositing 0.2 μm of silicon nitride or aluminum nitride at a temperature below the hardbaked temperature of the sacrificial layers 108, 112, 120 and 128.

Figure 8P:
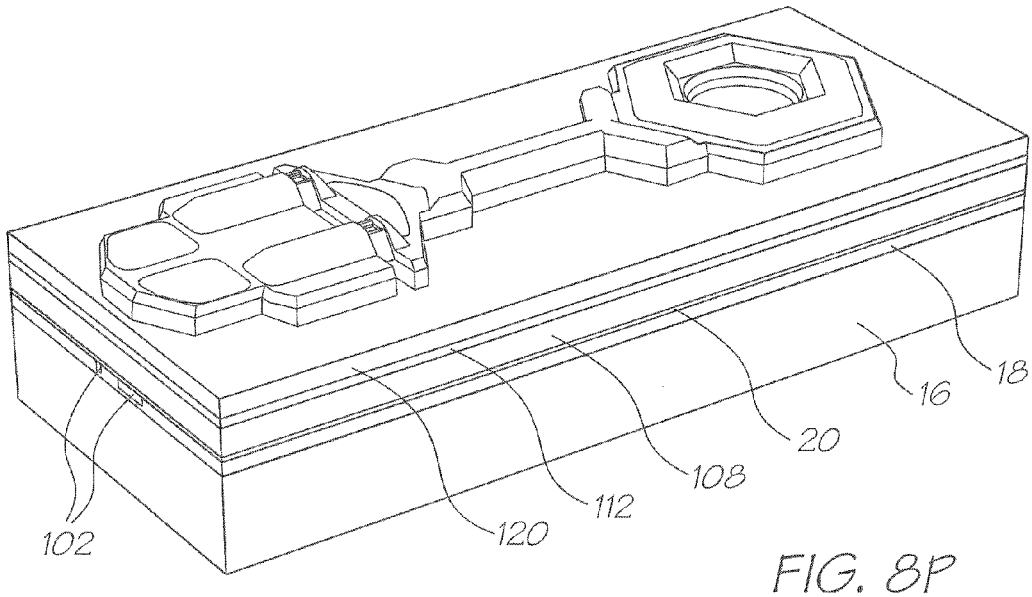
Figure 9P:
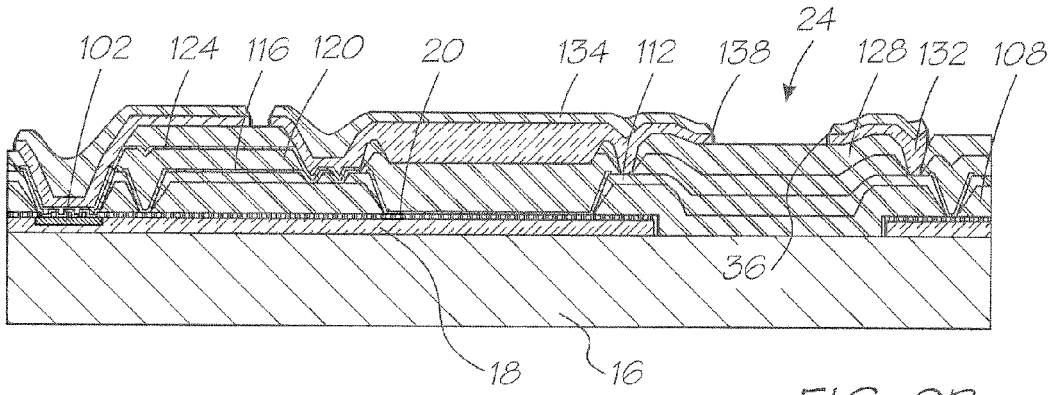
Figure 8Q:
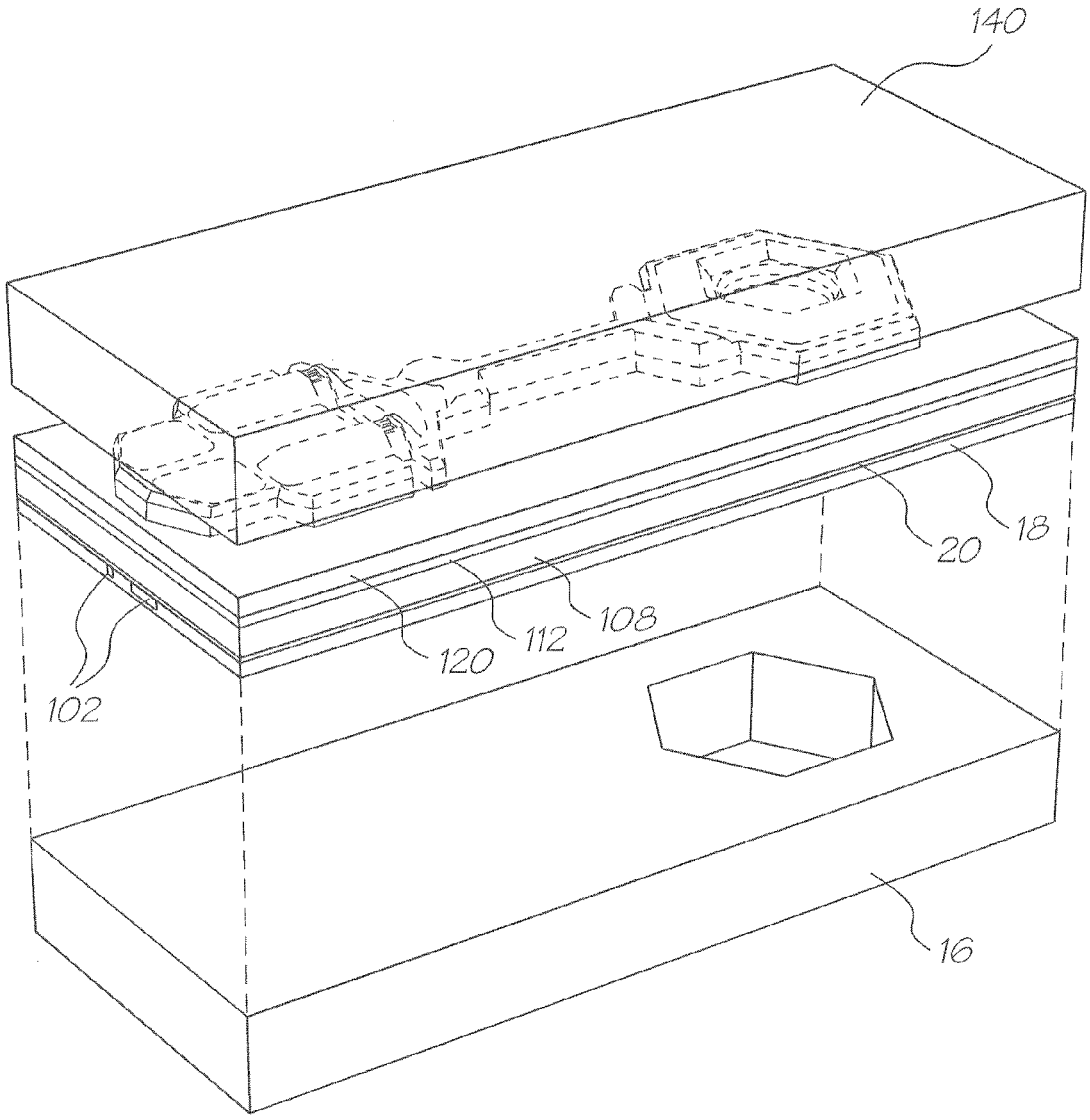
Figure 9Q:
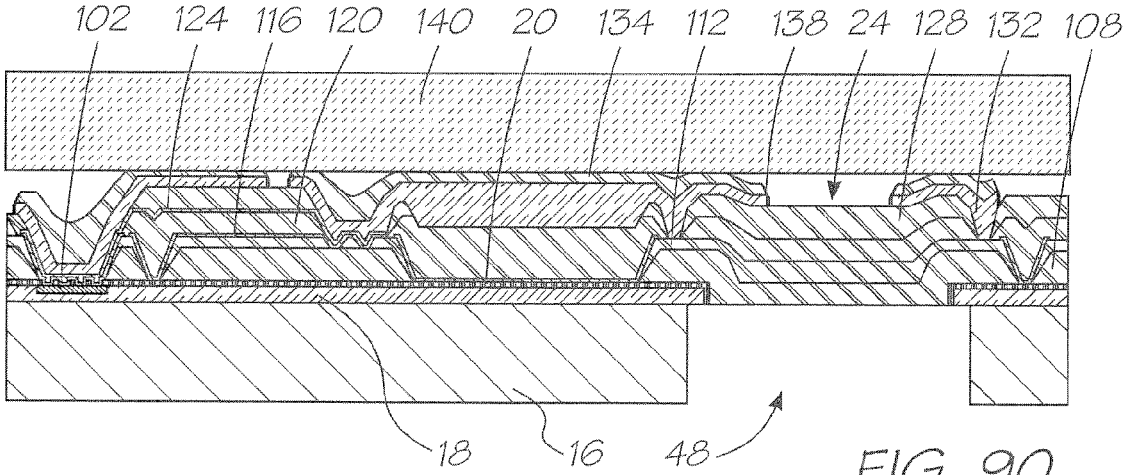
Figure 10K:
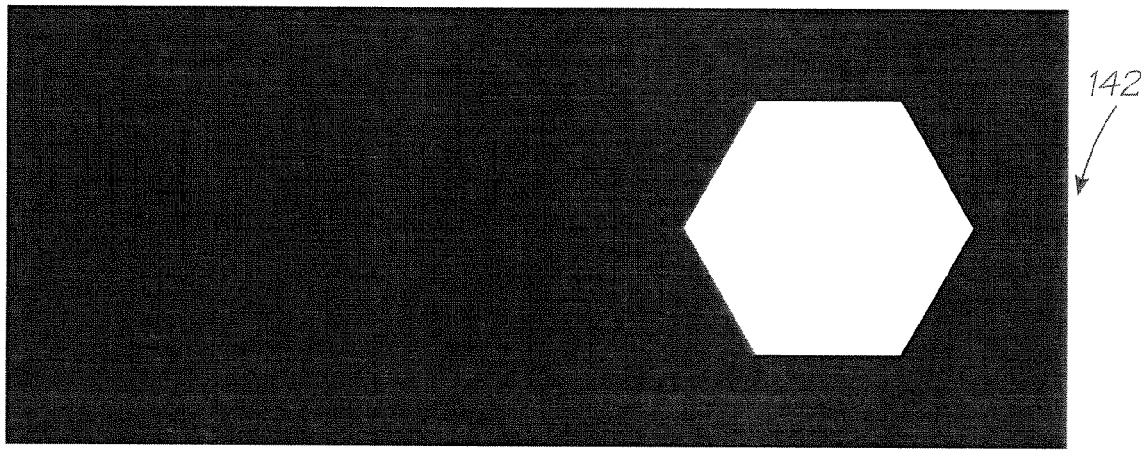

Then, as shown in FIG. 8*p* of the drawings, the layer 138 is anisotropically plasma etched to a depth of 0.35 microns. This etch is intended to clear the dielectric from the entire surface except the side walls of the dielectric layer 132 and the sacrificial layer 134. This step creates the nozzle rim 36 around the nozzle opening 24 which "pins" the meniscus of ink, as described above.

An ultraviolet (UV) release tape 140 is applied. 4 μm of resist is spun on to a rear of the silicon wafer 16. The wafer 16 is exposed to mask 142 to back etch the wafer 16 to define the ink inlet channel 48. The resist is then stripped from the wafer 16.

Figure 8R:
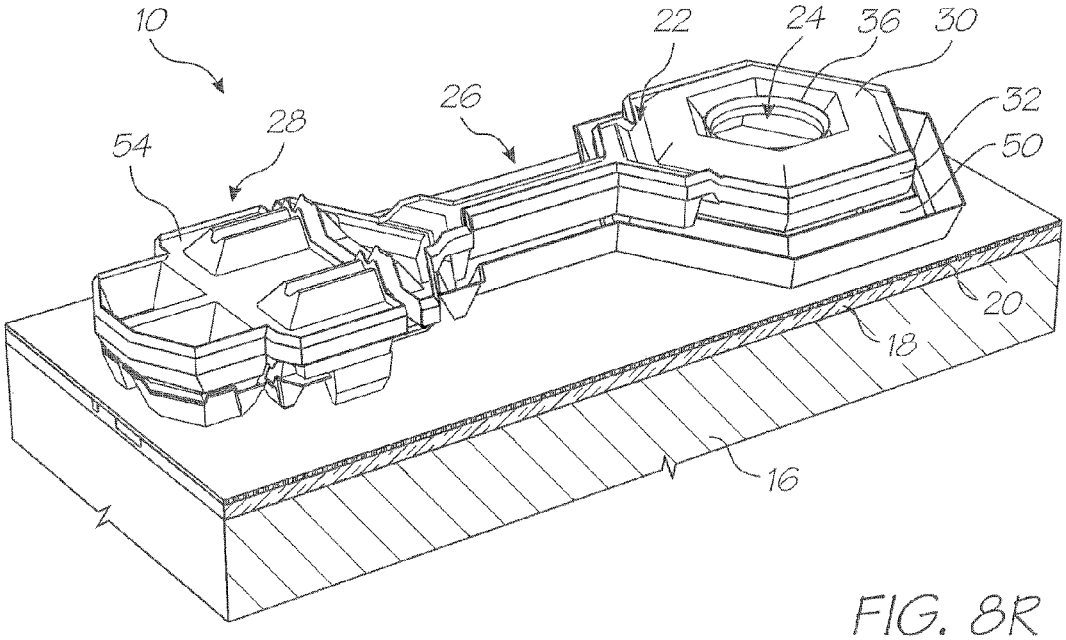
Figure 9R:
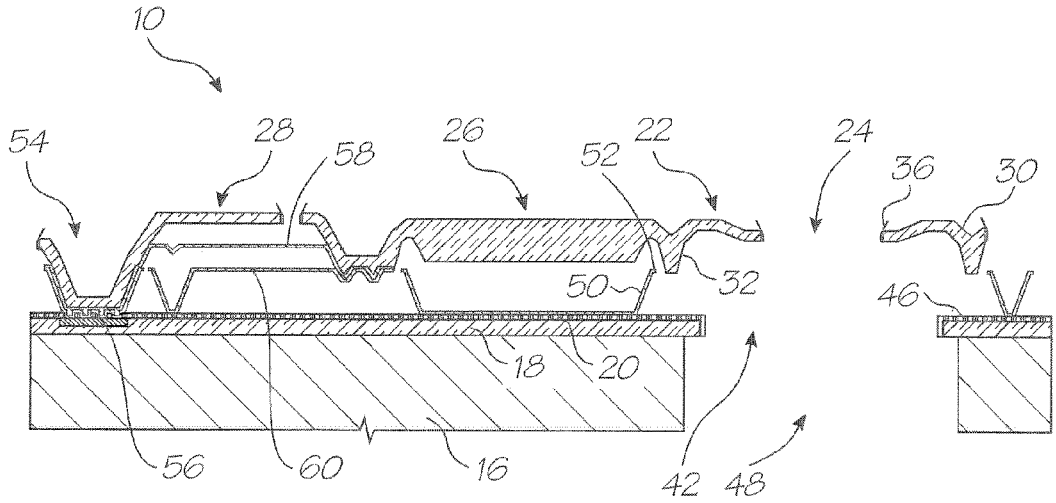
Figure 11A:
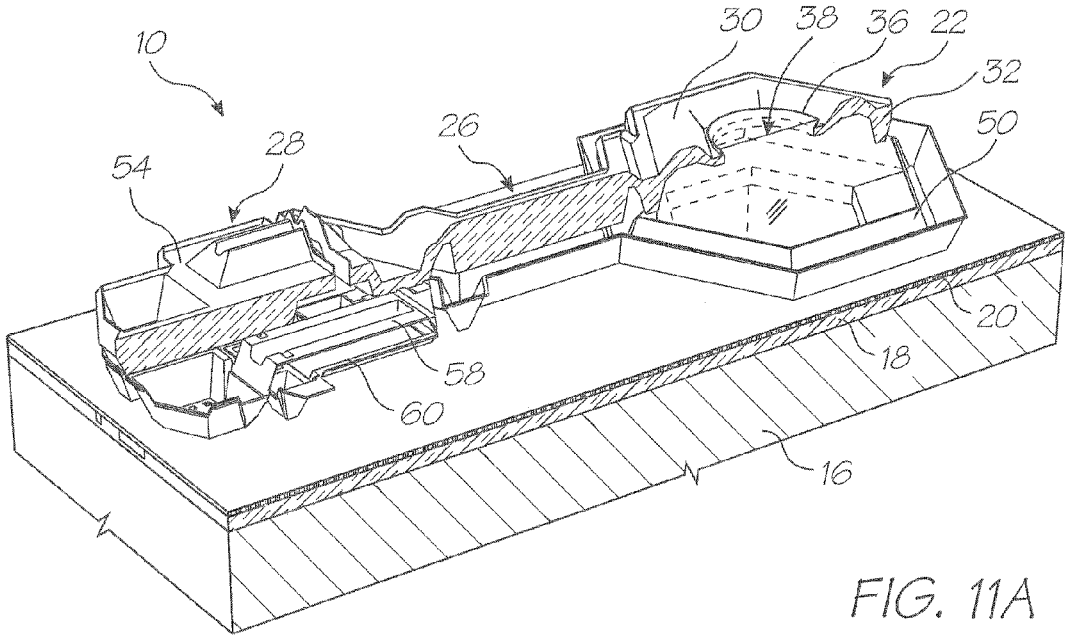
FIGS. 11*a* to 11*c* show three dimensional views of an operation of the nozzle assembly manufactured according to the method of FIGS. 8 and 9.
Figure 12A:
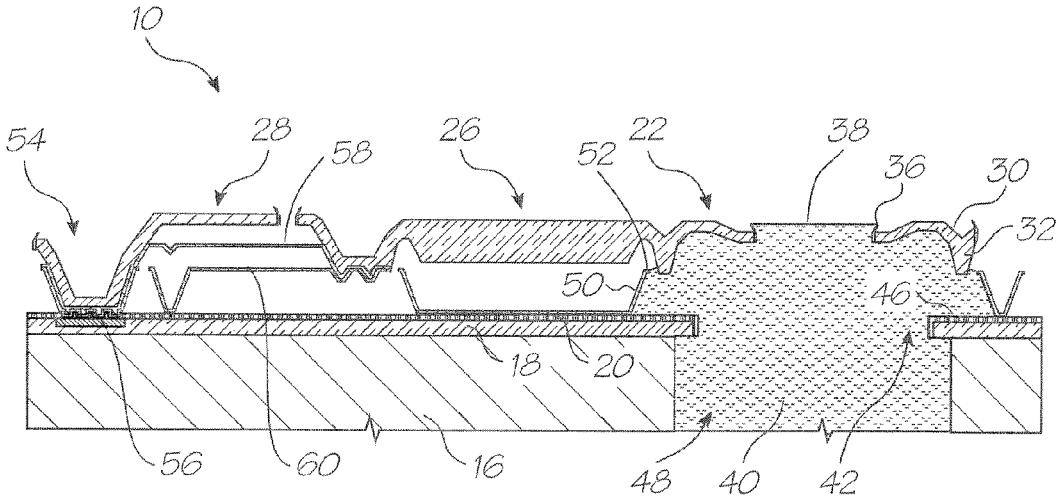
FIGS. 12*a* to 12*c* show sectional side views of an operation of the nozzle assembly manufactured according to the method of FIGS. 8 and 9.
Figure 11B:
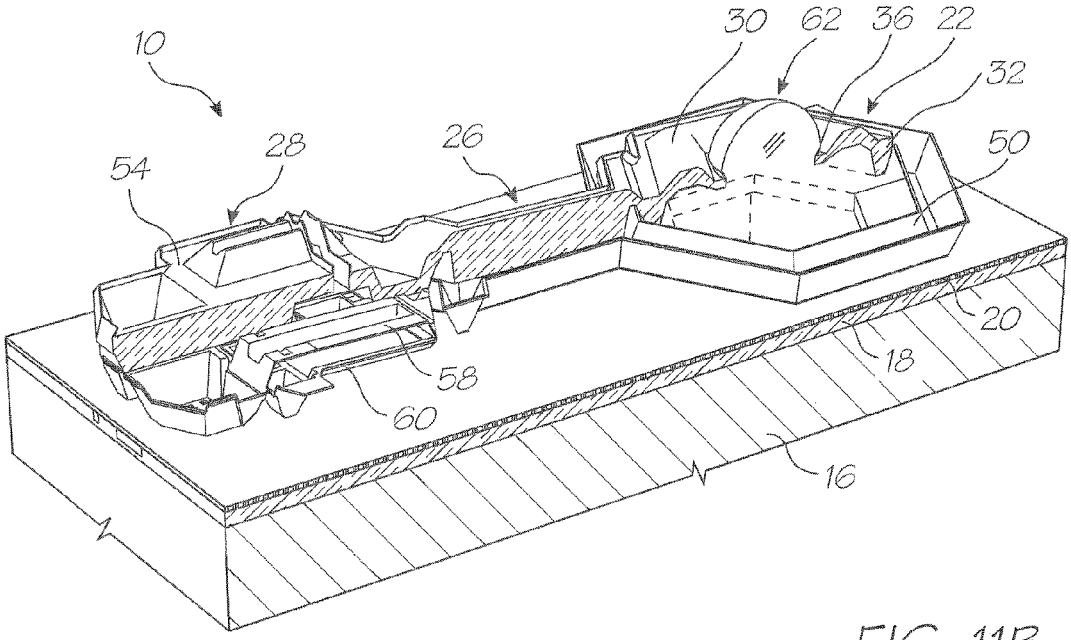
Figure 12B:
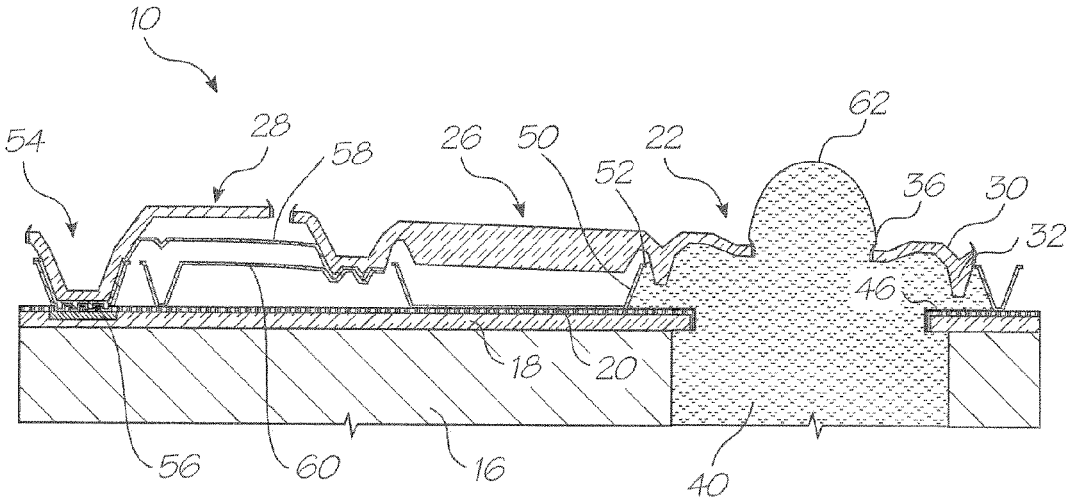
Figure 11C:
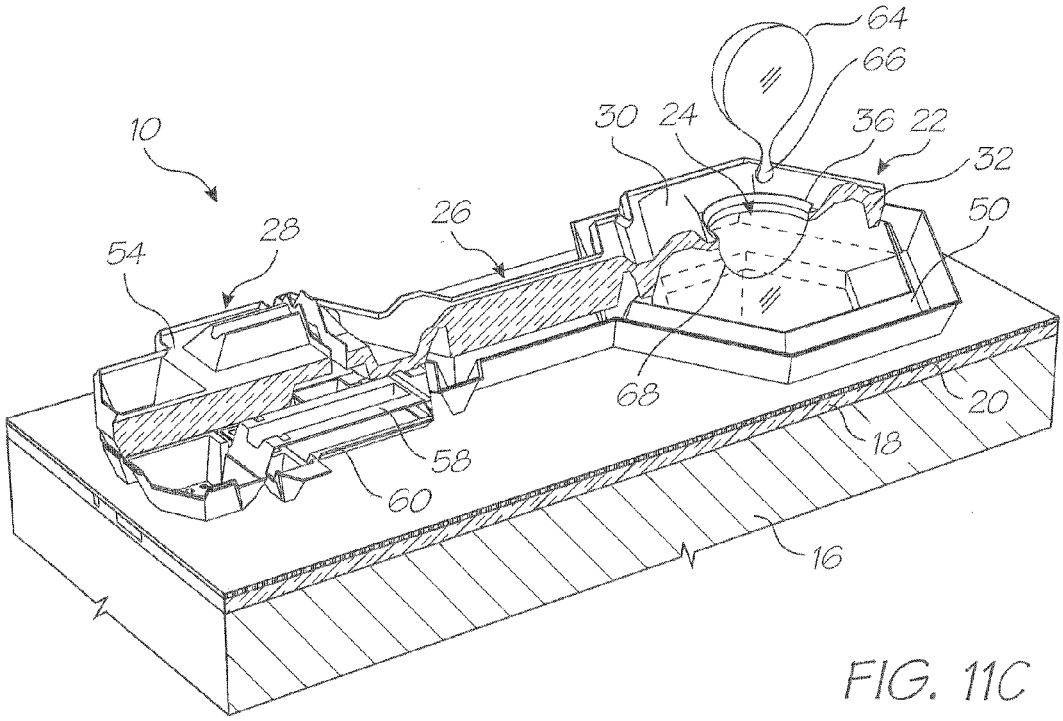
Figure 12C:
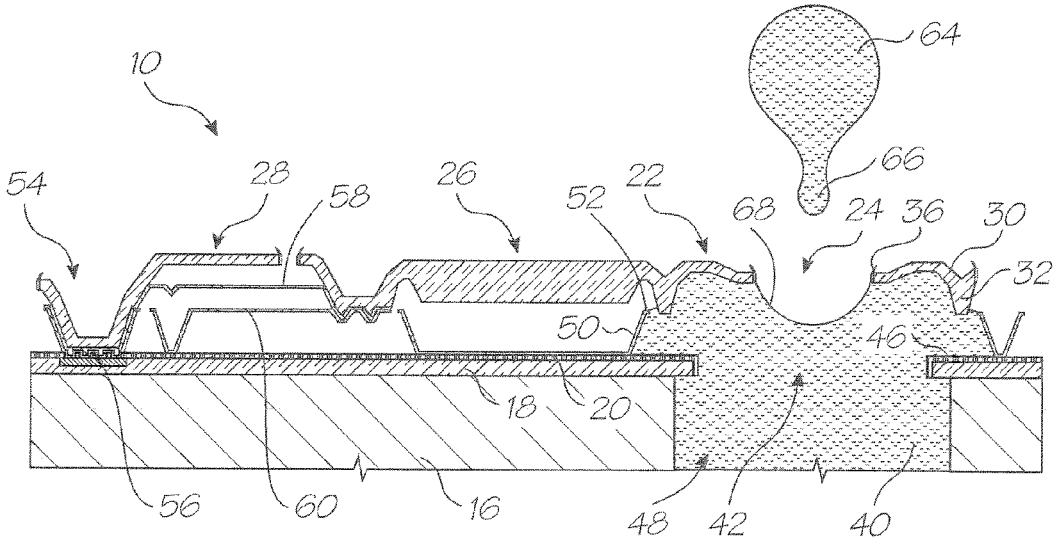

A further UV release tape (not shown) is applied to a rear of the wafer 16 and the tape 140 is removed. The sacrificial layers 108, 112, 120, 128 and 134 are stripped in oxygen plasma to provide the final nozzle assembly 10 as shown in FIGS. 8*r* and 9*r* of the drawings. For ease of reference, the reference numerals illustrated in these two drawings are the same as those in FIG. 1 of the drawings to indicate the relevant parts of the nozzle assembly 10. FIGS. 11 and 12 show the operation of the nozzle assembly 10, manufactured in accordance with the process described above with reference to FIGS. 8 and 9 and these figures correspond to FIGS. 2 to 4 of the drawings.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A printhead integrated circuit assembly comprising:

a substrate having a plurality of micro-electromechanical nozzle arrangements formed thereon;

drive circuitry positioned on the substrate for operatively actuating the respective nozzle arrangements to eject a drop of printing fluid therefrom; and a controller configured to monitor the power required to eject a drop from each nozzle, and to deactivate such nozzle and compensate with another nozzle if a required power level is exceeded, wherein the drive circuitry actuates a nozzle arrangement by causing a current to flow to an actuator beam thereof to produce thermal expansion of said beam.

2. The printhead integrated circuit assembly of claim 1, wherein the controller monitors the power required by monitoring the energy required to actuate the actuator beam.

3. The printhead integrated circuit assembly of claim 1, wherein the actuator beam is connected to the drive circuitry in the form of a CMOS layer by means of conductive pads.

4. The printhead integrated circuit assembly of claim 1, wherein the nozzle arrangements are hexagonally shaped to allow for close packing of the nozzles on the substrate.

5. The printhead integrated circuit assembly of claim 1, wherein the nozzle arrangements are arranged in staggered rows on the substrate to allow for close packing of such nozzles.

6. The printhead integrated circuit assembly of claim 1, wherein each nozzle arrangement includes a containment formation to isolate leaked or misdirected ink from adjacent nozzle arrangements to prevent interference between nozzle arrangements.

* * * * *